US009840085B2

(12) United States Patent
Miyako

(10) Patent No.: US 9,840,085 B2
(45) Date of Patent: Dec. 12, 2017

(54) LIQUID EJECTING APPARATUS AND LIQUID EJECTING METHOD

(71) Applicant: SEIKO EPSON CORPORATION, Tokyo (JP)

(72) Inventor: Yuichiro Miyako, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/356,981

(22) Filed: Nov. 21, 2016

(65) Prior Publication Data

US 2017/0151804 A1 Jun. 1, 2017

(30) Foreign Application Priority Data

Nov. 26, 2015 (JP) ..... 2015-230470

(51) Int. Cl.
*B41J 2/175* (2006.01)

(52) U.S. Cl.
CPC ..... *B41J 2/17596* (2013.01); *B41J 2/1752* (2013.01); *B41J 2/17523* (2013.01); *B41J 2/17566* (2013.01); *B41J 2002/17573* (2013.01)

(58) Field of Classification Search
CPC .... B41J 2/175; B41J 2/17509; B41J 2/17573; B41J 2/17596; B41J 2/185; B41J 2002/1853; B41J 2002/1856
See application file for complete search history.

(56) References Cited

U.S. PATENT DOCUMENTS 6,520,630 B1 * 2/2003 Oda ..... B41J 2/17503 347/85
7,168,800 B2 * 1/2007 Katayama ..... B41J 2/17566 347/7
7,234,800 B2 * 6/2007 Watanabe ..... B41J 2/17523 347/85
7,628,478 B2 12/2009 Inoue
8,210,666 B2 * 7/2012 Hirashima ..... B41J 2/16523 347/85
9,156,272 B2 * 10/2015 Tamada ..... B41J 2/17509

FOREIGN PATENT DOCUMENTS

JP 2002-219815 A 8/2002
JP 2007-062189 A 3/2007

* cited by examiner

*Primary Examiner* — Anh T. N. Vo
(74) *Attorney, Agent, or Firm* — Workman Nydegger

(57) ABSTRACT

A liquid ejecting apparatus includes: an attachment unit to which a liquid container that contains liquid is attachable; a liquid ejecting head that ejects the liquid; and a connection portion that is provided on the attachment unit and is detachably inserted into a connection port of the liquid container. The connection portion has at least one opening of a first flow passage and at least one opening of a second flow passage separately. The first flow passage is a passage through which the liquid contained in the liquid container is sent to the liquid ejecting head. The second flow passage is a passage through which the liquid contained in the liquid container is sent, but not to the liquid ejecting head.

12 Claims, 18 Drawing Sheets

LIQUID EJECTING APPARATUS AND LIQUID EJECTING METHOD

BACKGROUND

1. Technical Field

The present invention relates to a technique for ejecting liquid such as ink onto a medium.

2. Related Art

Various kinds of structure for fixing a cartridge that contains ink such as ink have been proposed. For example, the following structure is disclosed in JP-A-2007-062189. Two connection portions are provided on a cartridge. An ink taking-out opening and an ink filling opening are formed separately in each of the two connection portions. When the cartridge is attached to a cartridge attachment unit, the ink taking-out opening is connected to a flow passage through which ink is supplied to an ink-ejecting head, and the ink filling opening is connected to a flow passage toward a replenishment tank.

When plural flow-passage openings connected to respective different flow passages are formed in a cartridge as in the ink taking-out opening and the ink filling opening of JP-A-2007-062189, if these openings are formed in each of plural connection portions separately for connection to the corresponding flow passage of a cartridge attachment unit separately, the positioning of each of these connection portions in relation to the corresponding flow passage of the cartridge attachment unit is necessary, resulting in a complex connection portion structure.

SUMMARY

An advantage of some aspects of the invention is to simplify the structure of a connection portion for connection of a liquid container and an attachment unit.

A liquid ejecting apparatus according to an aspect of the invention comprises: an attachment unit to which a liquid container that contains liquid is attachable; a liquid ejecting head that ejects the liquid; and a connection portion that is provided on the attachment unit and is detachably inserted into a connection port of the liquid container, wherein the connection portion has at least one opening of a first flow passage and at least one opening of a second flow passage separately, wherein the first flow passage is a passage through which the liquid contained in the liquid container is sent to the liquid ejecting head, and wherein the second flow passage is a passage through which the liquid contained in the liquid container is sent, but not to the liquid ejecting head. Since the opening of the first flow passage and the opening of the second flow passage are formed in the connection portion of the attachment unit separately, it is possible to connect both the opening of the first flow passage and the opening of the second flow passage to the inside of the liquid container by attaching the liquid container in such a way that the connection portion of the attachment unit enters the connection port of the liquid container. Therefore, as compared with a case where a connection portion for the opening of the first flow passage and a connection portion for the opening of the second flow passage are provided separately from each other, it is possible to simplify the structure of the connection portion for connection of the liquid container and the attachment unit.

Preferably, the level of the opening of the second flow passage is higher than the level of the opening of the first flow passage in a vertical direction. With this preferred mode, the liquid level in the liquid container is never below the level of the opening of the first flow passage when, for example, the liquid is sucked out of the liquid container through the opening of the second flow passage. Therefore, with this structure, it is possible to prevent air bubbles, etc. from entering through the opening of the first flow passage leading to the liquid ejecting head.

Preferably, as viewed in the direction of insertion of the connection portion, the opening of the first flow passage and the opening of the second flow passage are arranged to surround the center of the connection portion. With this preferred mode, it is possible to make it easier to insert the connection portion into the connection port of the liquid container by, for example, adopting a pointed tip at the center of the connection portion as compared with a case where an opening is located at the center of the connection portion.

Preferably, the connection portion protrudes upward from an inner bottom surface of the attachment unit. With this preferred mode, it is possible to apply the invention to a case where the liquid container is attached to the bottom surface of the attachment unit.

Preferably, the connection portion protrudes sideways from an inner side surface of the attachment unit. With this preferred mode, it is possible to apply the invention to a case where the liquid container is attached to the side surface of the attachment unit.

Preferably, the liquid ejecting head and the attachment unit are provided on a moving member that reciprocates. With this preferred mode, it is possible to apply the invention to a case where the liquid container is mounted on the moving member on which the liquid ejecting head is provided.

Preferably, the liquid ejecting head is provided on a moving member that reciprocates; and the attachment unit is provided on the body of the liquid ejecting apparatus. With this preferred mode, it is possible to apply the invention to a case where the liquid container is mounted on the body of the liquid ejecting apparatus.

Preferably, the liquid ejecting head is an elongated line head; and the liquid ejecting head and the attachment unit are fixed. With this preferred mode, it is possible to apply the invention to a case where the liquid ejecting head is a line head.

Preferably, the liquid ejecting apparatus further comprises: a third flow passage for collection of the liquid sent through the second flow passage, wherein the third flow passage is detachably connected to the second flow passage. Since the third flow passage for collection of the liquid is detachably connected to the second flow passage of the attachment unit, with this preferred mode, it is possible to provide the third flow passage in other element (e.g., collection unit) that is not the attachment unit, in which the second flow passage is provided.

Preferably, a liquid ejecting apparatus comprises: an attachment unit to which a plurality of liquid containers each containing liquid is attachable; a liquid ejecting head that ejects the liquid; and a plurality of connection portions provided on the attachment unit, each of the plurality of connection portions being detachably inserted into a corresponding connection port of the corresponding liquid container, wherein each of the plurality of connection portions has at least one opening of a first flow passage and at least one opening of a second flow passage separately, wherein the first flow passage is a passage through which the liquid contained in the liquid container is sent to the liquid ejecting head, and wherein the second flow passage is a passage through which the liquid contained in the liquid container is sent, but not to the liquid ejecting head. With this preferred mode, for each of the plurality of liquid containers, it is possible to simplify the structure of the connection portion for connection of the liquid container and the attachment unit.

Preferably, the liquid ejecting apparatus further comprises: a third flow passage for collection of the liquid sent through the second flow passage, wherein the third flow passage is detachably connected to each of the second flow passages. With this preferred mode, it is possible to collect the liquid through only the second flow passage connected to, among the plurality of liquid containers, the desired liquid container.

A liquid ejecting method in a preferred aspect is as follows. A liquid ejecting apparatus includes an attachment unit to which a plurality of liquid containers each containing liquid is attachable, a liquid ejecting head that ejects the liquid, a plurality of connection portions provided on the attachment unit, each of the plurality of connection portions being detachably inserted into a corresponding connection port of the corresponding liquid container, each of the plurality of connection portions having at least one opening of a first flow passage and at least one opening of a second flow passage separately, the first flow passage being a passage through which the liquid contained in the liquid container is sent to the liquid ejecting head, the second flow passage being a passage through which the liquid contained in the liquid container is sent, but not to the liquid ejecting head, a third flow passage for collection of the liquid sent through the second flow passage being connected to each of the second flow passages, a valve being provided between each of the second flow passages and the third flow passage so as to be able to open and close therebetween, and a detector that detects an amount of the liquid left in each of the plurality of liquid containers. The liquid ejecting method comprises: detecting, by the detector, among the plurality of liquid containers, a liquid container in which the amount of the liquid left is not larger than a predetermined amount; opening the valve between the third flow passage and the second flow passage corresponding to the connection portion inserted in the connection port of the detected liquid container; and sucking the liquid out of the liquid container through the second flow passage to which the third flow passage is connected, thereby collecting the sucked liquid through the third flow passage. With this preferred aspect, it is possible to collect the liquid through only the second flow passage connected to, among the plurality of liquid containers, the liquid container whose remaining liquid amount has been detected to be not larger than the predetermined amount.

A liquid ejecting method in another preferred aspect is as follows. A liquid ejecting apparatus includes an attachment unit to which a plurality of liquid containers each containing liquid is attachable, a liquid ejecting head that ejects the liquid, a plurality of connection portions provided on the attachment unit, each of the plurality of connection portions being detachably inserted into a corresponding connection port of the corresponding liquid container, each of the plurality of connection portions having at least one opening of a first flow passage and at least one opening of a second flow passage separately, the first flow passage being a passage through which the liquid contained in the liquid container is sent to the liquid ejecting head, the second flow passage being a passage through which the liquid contained in the liquid container is sent, but not to the liquid ejecting head, a third flow passage for collection of the liquid sent through the second flow passage being detachably connected to each of the second flow passages, and a detector that detects an amount of the liquid left in each of the plurality of liquid containers. The liquid ejecting method comprises: detecting, by the detector, among the plurality of liquid containers, a liquid container in which the amount of the liquid left is not larger than a predetermined amount; connecting the third flow passage to the second flow passage corresponding to the connection portion inserted in the connection port of the detected liquid container; and sucking the liquid out of the liquid container through the second flow passage to which the third flow passage is connected, thereby collecting the sucked liquid through the third flow passage. With this preferred aspect, it is possible to collect the liquid through only the second flow passage connected to, among the plurality of liquid containers, the liquid container whose remaining liquid amount has been detected to be not larger than the predetermined amount.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
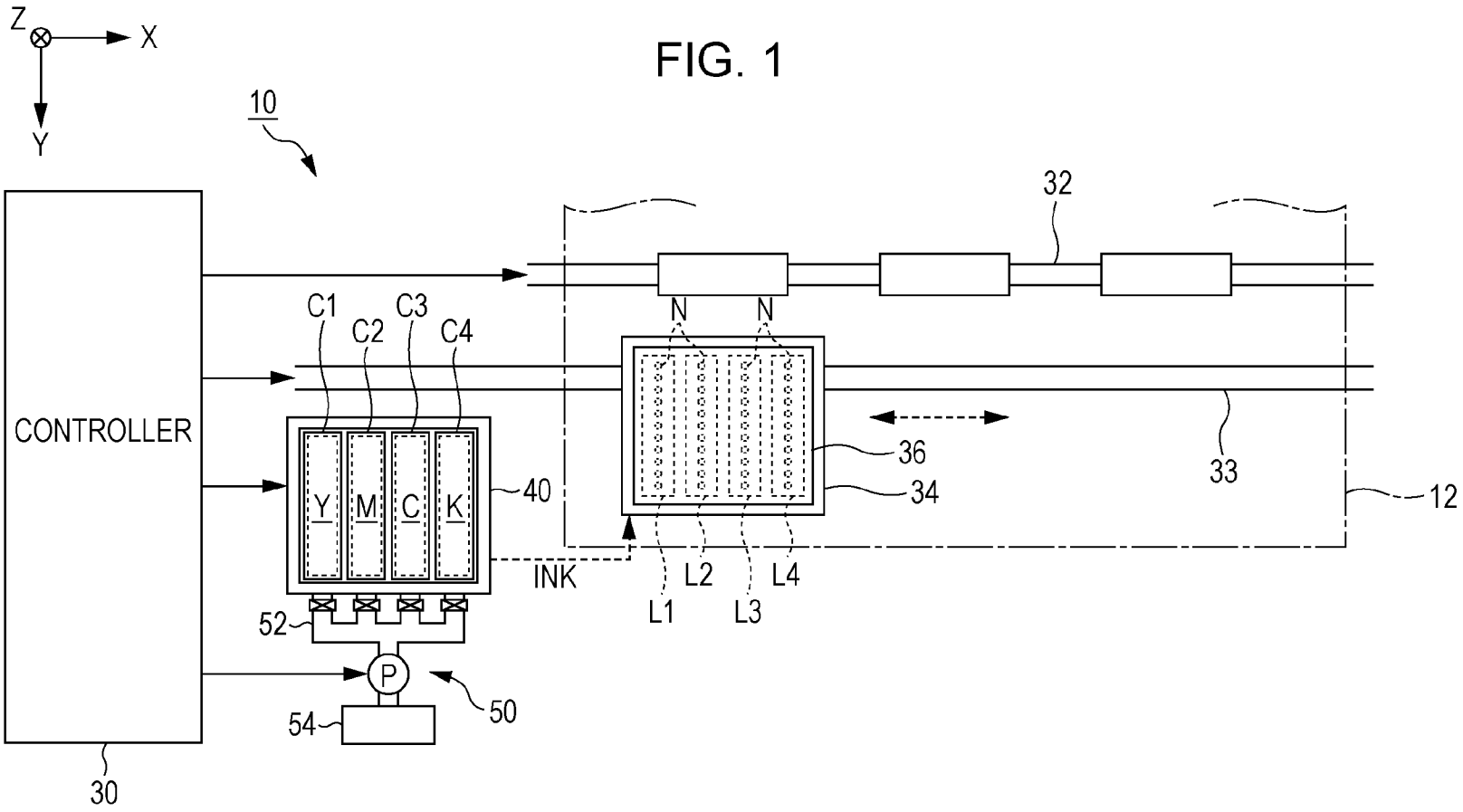
FIG. 1 is a structure diagram of a printing apparatus according to a first embodiment.

FIG. 1 is a partial structure diagram of an ink-jet printing apparatus 10 according to a first embodiment of the invention. The printing apparatus 10 is a liquid ejecting apparatus that ejects ink, which is an example of liquid, onto a medium (ejection target) 12 such as printing paper. In the first embodiment, a so-called off-carriage-type structure, in which a liquid container such as an ink container is mounted on the body of the printing apparatus 10, is taken as an example. The printing apparatus 10 includes a controller 30, a transportation mechanism 32, a movement mechanism 33, a carriage 34, and a liquid ejecting head 36. The carriage 34 is an example of a moving member.

An attachment unit (cartridge holder) 40 is provided on the printing apparatus 10. A plurality of liquid containers (cartridges) C1 to C4 is attachable to the attachment unit 40. Plural types of ink are contained in the respective containers separately. Ink is liquid that contains a colorant such as pigment or dye (color ink). For example, the liquid is ink of four colors, specifically, cyan (C), magenta (M), yellow (Y), and black (K). The ink may contain a resin material. In the present embodiment, the liquid containers C1 to C4 contain yellow ink (Y), magenta ink (M), cyan ink (C), and black ink (K) respectively. A collection unit 50 for collection of the ink contained in the liquid containers C1 to C4 is connected to the attachment unit 40. A detailed explanation of the attachment unit 40 and the collection unit 50 will be given later.

The controller 30 illustrated in FIG. 1 centrally controls the elements of the printing apparatus 10. The controller 30 includes, for example, a control circuit such as a CPU (Central Processing Unit), a ROM (Read Only Memory), and a RAM (Random Access Memory), etc. The ROM is, for example, a rewritable flash ROM. Programs that are to be run by the controller 30 and various kinds of data necessary for running the programs are stored in the ROM. Data, etc. used temporarily when the controller 30 runs the programs are stored into the RAM. A management apparatus (not illustrated), for example, a personal computer, is connected to the controller 30. In accordance with instructions given from the management apparatus, the controller 30 centrally controls the elements of the printing apparatus 10.

Under the control of the controller 30, the liquid ejecting head 36 ejects ink of the respective colors supplied from the liquid containers C1 to C4 onto the medium 12. Four ink nozzle lines L1 to L4 are arranged on the ejecting face (surface that faces the medium 12) of the liquid ejecting head 36 illustrated in FIG. 1. Each of the ink nozzle lines L1 to L4 is a group of plural nozzles N that are in a linear array along the Y direction. Each of the ink nozzle lines L1 to L4 may consist of plural columns (for example, zigzag array or staggered array).

Yellow ink (Y), which is supplied from the liquid container C1, is ejected from the nozzles N of the ink nozzle line L1. Magenta ink (M), which is supplied from the liquid container C2, is ejected from the nozzles N of the ink nozzle line L2. Cyan ink (C), which is supplied from the liquid container C3, is ejected from the nozzles N of the ink nozzle line L3. Black ink (K), which is supplied from the liquid container C4, is ejected from the nozzles N of the ink nozzle line L4.

Pressure compartments and piezoelectric elements that are not illustrated are provided in the liquid ejecting head 36 correspondingly to the nozzles N of each of the ink nozzle lines L1 to L4. Ink supplied from each of the liquid containers C1 to C4 is filled into the corresponding pressure compartments of the liquid ejecting head 36. A driving signal is supplied so as to cause each piezoelectric element to vibrate. This gives rise to a pressure change in the corresponding pressure compartment. As a result, ink in the corresponding pressure compartment is ejected from the corresponding nozzle N.

Under the control of the controller 30, the transportation mechanism 32 transports the medium 12 in the Y direction (sub scan direction). Under the control of the controller 30, the movement mechanism 33 causes the carriage 34 to reciprocate in the X direction (main scan direction). Concurrently with the transportation of the medium 12 and the reciprocation of the carriage 34, the liquid ejecting head 36 ejects ink onto the medium 12. As a result, a print-instructed image is formed on the surface of the medium 12. In the description below, the direction perpendicular to the X–Y plane (plane parallel to the surface of the medium 12) is denoted as Z direction. The direction in which ink is ejected by the liquid ejecting head 36 (vertically downward) corresponds to the Z direction.

Liquid Container Attachment Unit and Collection Unit

Figure 2:
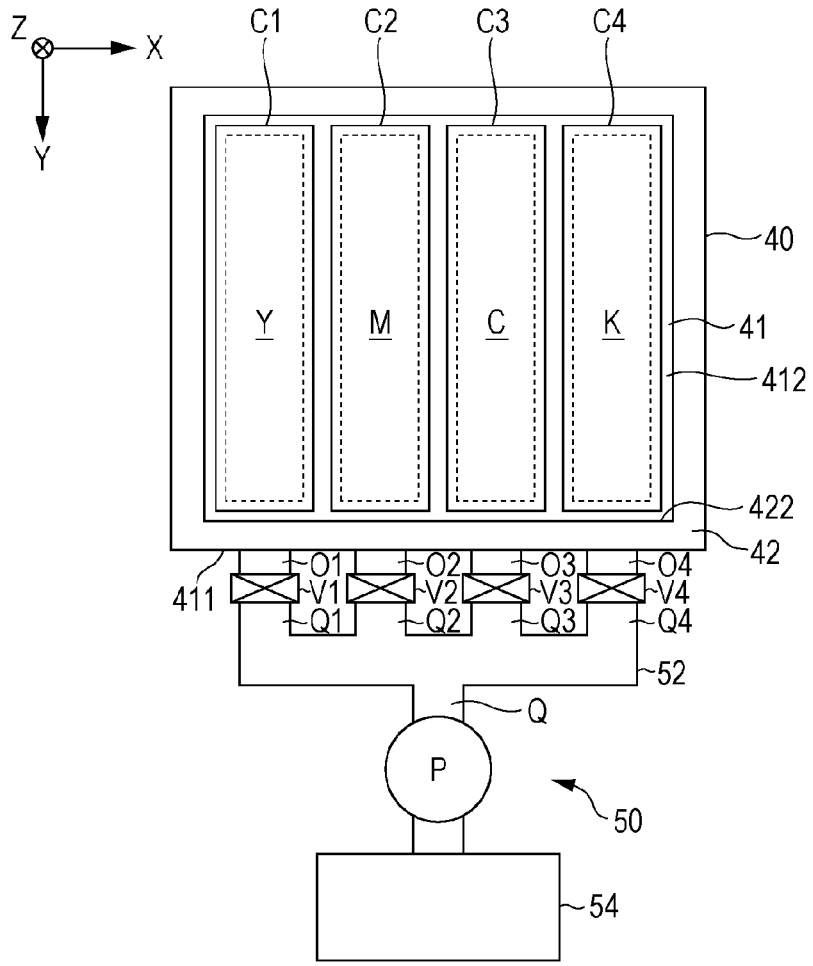
FIG. 2 is an enlarged view of an attachment unit for liquid containers illustrated in FIG. 1, and of a collection unit.
Figure 3:
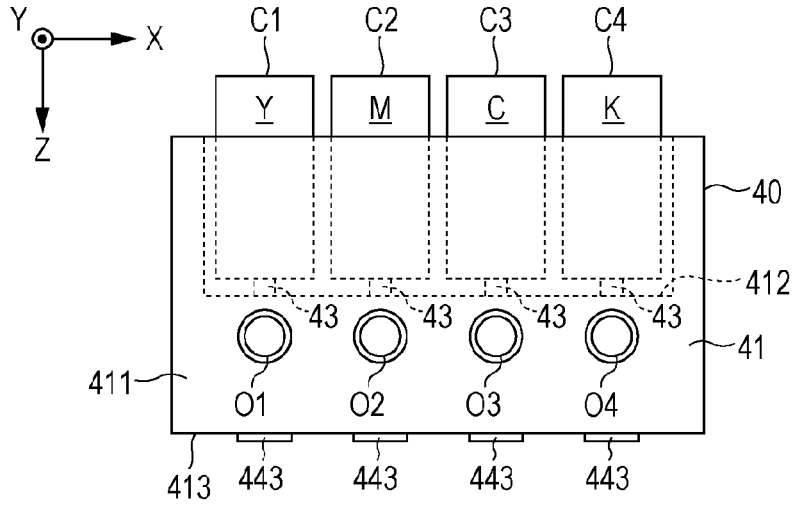
FIG. 3 is a side view of the attachment unit.

FIG. 2 is an enlarged view of the attachment unit 40 for the liquid containers C1 to C4, and of the collection unit 50. FIG. 3 is a side view of the attachment unit 40 from the positive side +Y in the Y direction. In FIG. 3, the illustration of the collection unit 50 is omitted. Each of the liquid containers C1 to C4 is an ink-tank-type cartridge made of a box-shaped container. The liquid container C1 to C4 is not limited to a box-shaped container. It may be an ink-pack-type cartridge having a bag container structure.

The attachment unit 40 in the first embodiment has an open-topped box structure. For example, it is formed integrally by injection-molding a resin material. The liquid containers C1 to C4 are arranged toward the positive side +X in the X direction and accommodated in a container-housing space surrounded by the inner bottom surface (floor) 412 of the bottom wall 41 of the attachment unit 40 and the inner side surfaces 422 of the sidewalls 42 thereof. A connection portion 43 is provided inside the container-housing space of the attachment unit 40 correspondingly to each of the liquid containers C1 to C4. In the first embodiment, the connection portions 43 are provided on the inner bottom surface 412. Each of the liquid containers C1 to C4 is detachably attached to the corresponding connection portion 43. A detailed explanation of the connection portion 43 will be given later.

The collection unit 50 includes a collection flow passage (third flow passage) 52, a suction pump P, and a collection container (collection tank) 54. The collection container 54 is a box-shaped container that contains collected ink. The collection flow passage 52 is made up of a main flow passage Q, which is in communication with the collection container 54, and four branch flow passages Q1 to Q4, which branch off from the main flow passage Q.

The suction pump P, which is driven by the controller 30, is provided on the main flow passage Q. Each of the branch flow passages Q1 to Q4 is connected to a side of the attachment unit 40, for example, to the corresponding one of openings O1 to O4, which are formed in a side 411 of a bottom wall portion 41 in the +Y direction. Each of the openings O1 to O4 is in communication with the inside of the corresponding one of the liquid containers C1 to C4 separately from the others through the corresponding connection portion 43 (described later) where the corresponding liquid container C1 to C4 is connected to the attachment unit 40. On each of the branch flow passages Q1 to Q4, the corresponding one of open/close valves V1 to V4 is provided. The opening and closing of the open/close valves V1 to V4 is controlled by the controller 30. With the structure described above, it is possible to individually suck ink of one of the liquid containers C1 to C4 for collection into the collection container 54 by controlling, by the controller 30, the open/close valves V1 to V4 so as to open one of the branch flow passages Q1 to Q4 and driving the suction pump P. Though a structure example in which the open/close valves V1 to V4 are provided on the collection unit 50 is illustrated in FIGS. 1 and 2, the open/close valves V1 to V4 may be provided on the attachment unit 40.

Connection of Attachment Unit and Liquid Container

Figure 4:
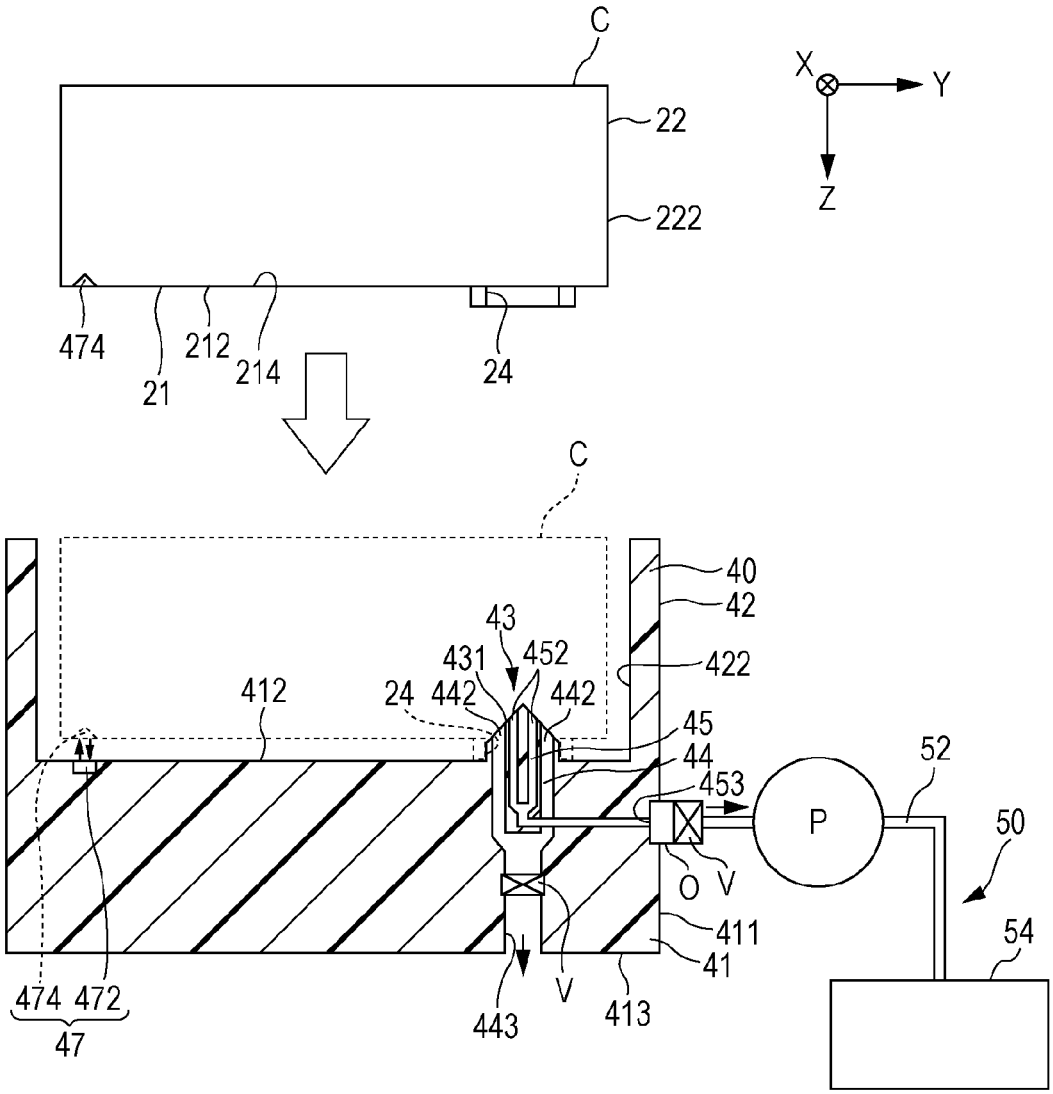
FIG. 4 is a sectional view of arbitrary one connection portion of the attachment unit, taken along the Y-Z plane.
Figure 5:
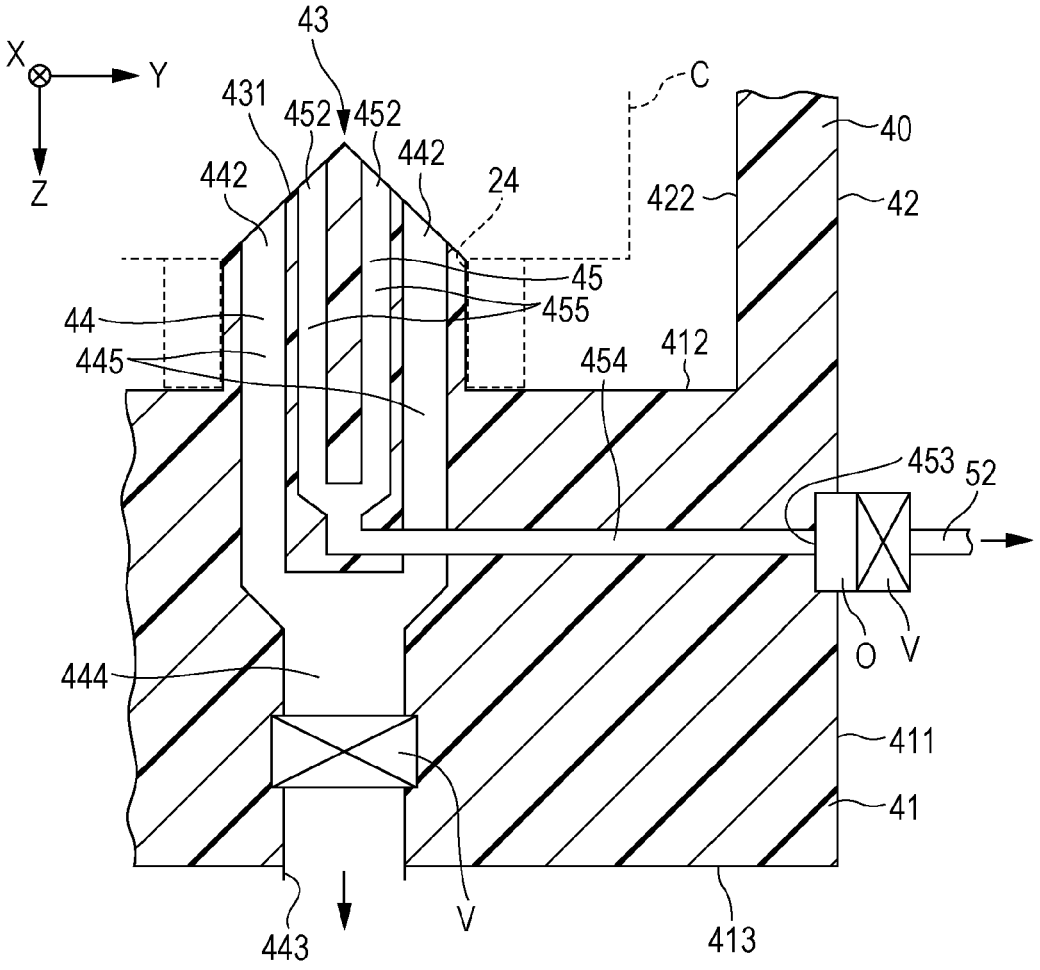
FIG. 5 is an enlarged view of the connection portion illustrated in FIG. 4.
Figure 6:
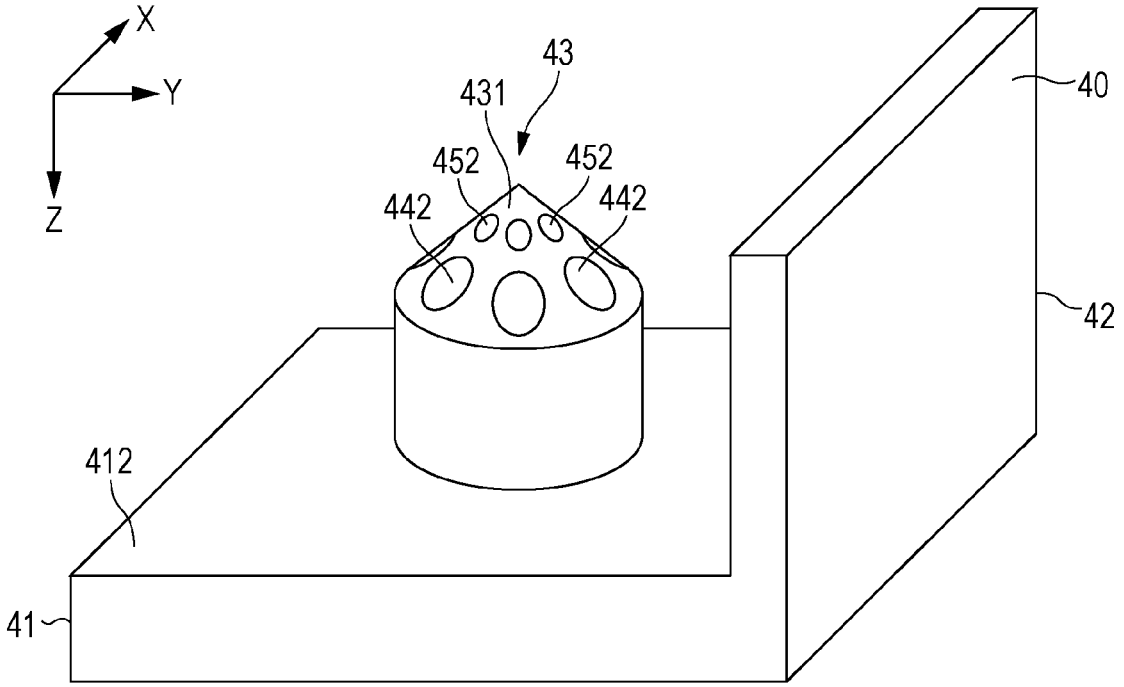
FIG. 6 is a perspective view of the connection portion illustrated in FIG. 4.
Figure 7:
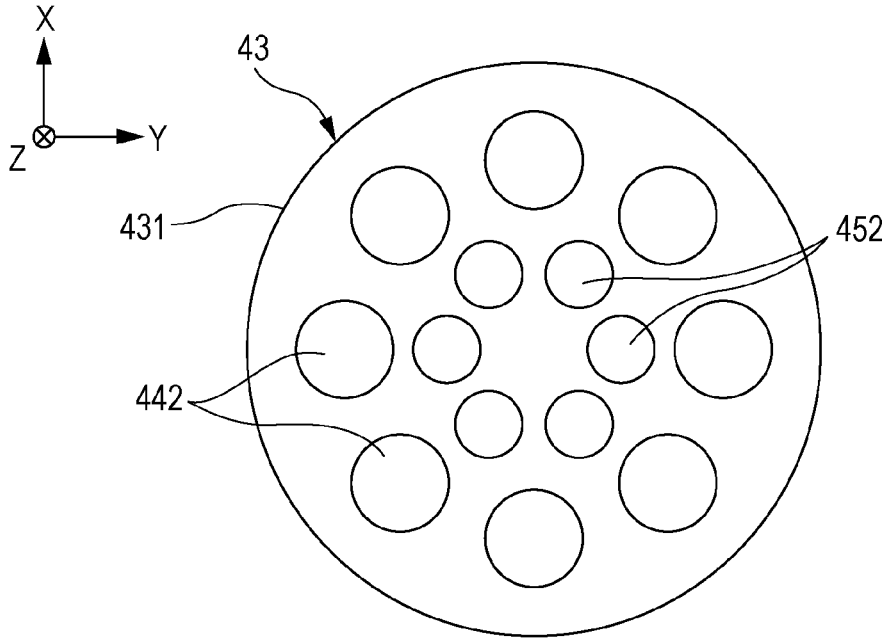
FIG. 7 is a top view of the connection portion illustrated in FIG. 4.

The connection portion 43 where the liquid container C1 to C4 is connected to the attachment unit 40 will now be explained in detail. FIG. 4 is a sectional view of arbitrary one connection portion of the attachment unit 40 illustrated in FIG. 2, taken along the Y-Z plane. FIG. 5 is an enlarged view of the connection portion 43 illustrated in FIG. 4. FIG. 6 is a perspective view of the connection portion 43. FIG. 7 is a view of the connection portion 43 in the Z direction (viewed from above vertically). The same structure applies to the connection portions 43 where the respective liquid containers C1 to C4 are connected to the attachment unit 40. Therefore, in the description below, arbitrary one of the liquid containers C1 to C4 is taken as a representative example and is denoted as C. The opening corresponding to the representative liquid container C is denoted as O, and the open/close valve corresponding to the representative liquid container C is denoted as V. With this representative one taken as an example, the connection of the liquid container C and the attachment unit 40 will now be explained.

As illustrated in FIG. 4, the liquid container C is detachably attached to the inner bottom surface 412 of the attachment unit 40. The connection portion 43 of the attachment unit 40 has a needle shape, meaning that its tip 431 is pointed. The pointed tip 431 is inserted into the liquid container C. More specifically, a cylindrical connection port 24, which is in communication with the inside of the liquid container C, is provided on the lower surface 212 of the bottom wall 21 of the liquid container C, and the connection portion 43 is inserted into the connection port 24.

As illustrated in FIGS. 5 and 6, the connection portion 43 of the attachment unit 40 protrudes from the inner bottom surface 412 toward the negative side −Z in the Z direction (vertically upward). The cone-shaped tip portion 431 of the connection portion 43 has, in its conical surface (slope), a plurality of inlets (openings) 442 of a first flow passage 44 and a plurality of inlets (openings) 452 of a second flow passage 45 separately. The first flow passage 44 is a passage through which ink contained in the liquid container C is sent to the liquid ejecting head 36 for ink ejection. The second flow passage 45 is a passage through which ink contained in the liquid container C is sent, but not to the liquid ejecting head 36. In the example described here, the second flow passage 45 is used as an ink collection passage, through which ink contained in the liquid container C is sent to the collection container 54.

As illustrated in FIG. 7, when the tip portion 431 of the connection portion 43 is viewed in the Z direction (direction of insertion), the plural flow-passage inlets 442 for ink ejection and the plural flow-passage inlets 452 for ink collection are arranged annularly to surround the center of the tip portion 431. With this annular arrangement, it is possible to make it easier to insert the connection portion into the connection port 24 of the liquid container C by adopting a center-pointed tip 431 as compared with a case where a flow-passage inlet 452 for ink collection is located at the center of the tip portion 431 (for example, as in FIG. 20 described later). For example, when a liquid container C with a film-covered connection port 24 in mint condition is designed to be attached to the attachment unit 40 by piercing the needle portion through the film of the connection port 24, the pointed annular array structure makes the piercing easier.

Figure 8:
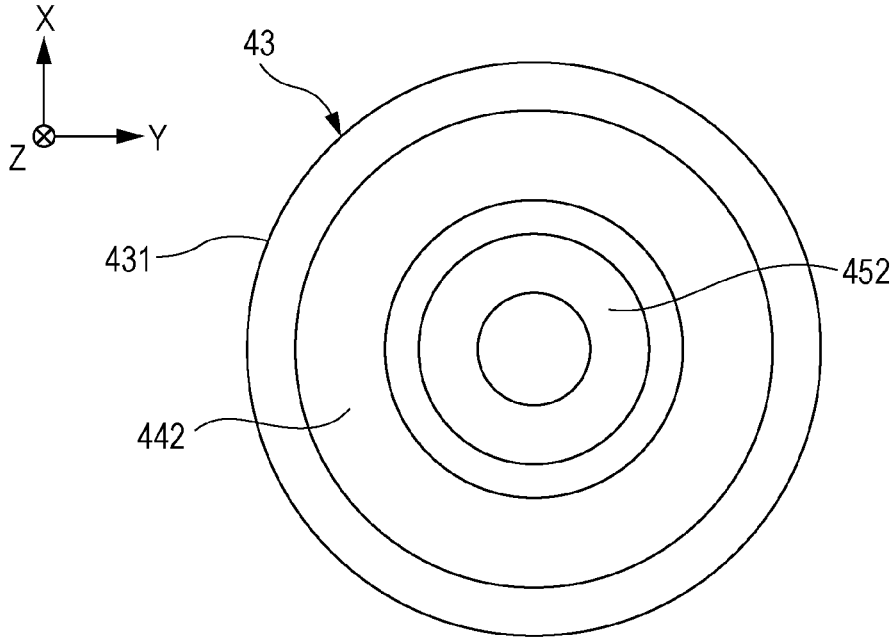
FIG. 8 is view of a variation example of the top portion of the connection portion according to the first embodiment.

The plural flow-passage inlets 442 for ink ejection are arranged to encircle the plural flow-passage inlets 452 for ink collection. In other words, the flow-passage inlets 442 are located outside in relation to the flow-passage inlets 452. Therefore, as compared with a case where the flow-passage inlets 442 are located inside in relation to the flow-passage inlets 452 (for example, similarly to FIG. 21 described later), it is harder for air bubbles, etc. to enter through the flow-passage inlets 452 for ink collection. The flow-passage inlets 442 for ink ejection and the flow-passage inlets 452 for ink collection are not limited to plural annular-array through holes as in FIG. 7. For example, as illustrated in FIG. 8, the inlet shape may be a ring-groove shape.

As illustrated in FIG. 5, the plural flow-passage inlets 452 for ink collection are located above the plural flow-passage inlets 442 for ink ejection in the Z direction (vertical direction). With this structure, since the surface of ink (liquid level) is never below the level of the plural flow-passage inlets 442 for ink ejection when the ink is sucked through the flow-passage inlets 452, it is possible to prevent air bubbles, etc. from entering through the flow-passage inlets 442. A more detailed explanation of this benefit will be given later.

The first flow passage 44 for ink supply is made up of a main flow passage 444 and branch flow passages 445. The main flow passage 444 is in communication with a flow-passage outlet 443, which is open at the lower surface 413 of the bottom wall 41 of the attachment unit 40. The branch flow passages 445 branching off from the main flow passage 444 are in communication with the respective flow-passage inlets 442. A non-return valve Vs for preventing ink from flowing backward is provided on the main flow passage 444. A pump (not illustrated) that sends ink to the liquid ejecting head 36 is connected to the flow-passage outlet 443. On the other hand, the second flow passage 45 for ink collection is made up of a main flow passage 454 and branch flow passages 455. The main flow passage 454 is in communication with a flow-passage outlet 453. The branch flow passages 455 branching off from the main flow passage 454 are in communication with the respective flow-passage inlets 452. The flow-passage outlet 453 is connected to the opening O described earlier. The second flow passage 45 for ink collection is in communication with the collection flow passage 52 of the collection unit 50 through the opening O.

A liquid amount detector 47 is provided partially on the liquid container C and partially on the attachment unit 40. The liquid amount detector 47 detects the amount of ink left in the liquid container C. For example, as illustrated in FIG. 4, the liquid amount detector 47 is made up of an optical sensor 472, which is provided in the attachment unit 40, and a prism 474, which is provided in the liquid container C. The prism 474 is a transparent member that has an isosceles-triangular shape with slopes. The liquid container C has a through-hole-type window in the bottom wall 21, and the prism 474 is hermetically embedded in the window. The apex defined by the slopes of the isosceles triangle is oriented upward in the vertical direction. The optical sensor 472 is embedded in the bottom wall 41 of the attachment unit 40. The optical sensor 472 and the prism 474 face each other. Under the control of the controller 30, the optical sensor 472 emits light toward the prism 474 and receives light reflected therefrom. On the basis of the amount of the reflection light received, the amount of ink left in the liquid container C is detected. The structure of the liquid amount detector 47 is not limited to the above example.

As illustrated in FIG. 4, when the liquid container C is attached to the inner bottom surface 412 of the attachment unit 40 having the above structure, the connection portion 43 enters the connection port 24 of the liquid container C. When this insertion is performed, the tip portion 431 of the attachment unit 40 becomes positioned inside the liquid container C in such a way as to protrude upward from the upper surface (inner bottom surface) 214 of the bottom wall 21 of the liquid container C. By attaching the liquid container C to the attachment unit 40 in such a way that the connection portion 43 of the attachment unit 40 enters the connection port 24 of the liquid container C in this way, it is possible to obtain the fluid connection of both the inlets 442 of the first flow passage 44 and the inlets 452 of the second flow passage 45 to the inside of the liquid container C. Therefore, with a single connection portion 43, as compared with a case where a connection portion for the inlets 442 of the first flow passage 44 and a connection portion for the inlets 452 of the second flow passage 45 are provided separately from each other, it is possible to simplify the connection structure. To supply ink to the liquid ejecting head 36 from the liquid container C attached to the attachment unit 40, the pump, which is not illustrated, is driven. When pumped, ink flows out of the liquid container C into the ink-supplying flow-passage inlets 442 of the connection portion 43, and next through the first flow passage 44. By this means, it is possible to supply the ink to the liquid ejecting head 36.

Figure 9:
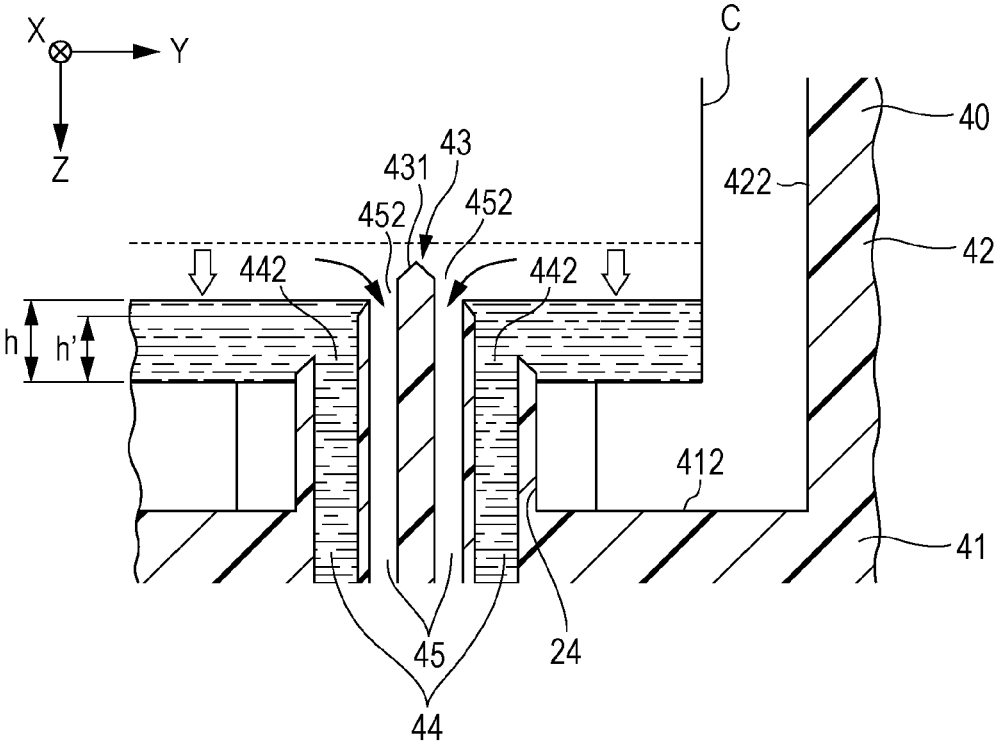
FIG. 9 is a diagram for explaining the operation of the connection portion illustrated in FIG. 4.

For ink collection into the collection container 54, the suction pump P of the collection unit 50 is driven. When pumped, ink flows out of the liquid container C into the ink-collecting flow-passage inlets 452 of the connection portion 43, and next through the second flow passage 45, and finally into the collection container 54. As illustrated in FIG. 9, the surface of ink (liquid level) in the vertical direction drops when ink is sucked out through the ink-collecting flow-passage inlets 452, and the drop in the liquid level stops at the level h of the ink-collecting flow-passage inlets 452. Since the level h of the ink-collecting flow-passage inlets 452 is above the level h' of the ink-supplying flow-passage inlets 442, the liquid level is never below the level h' of the ink-supplying flow-passage inlets 442 when the ink is sucked through the flow-passage inlets 452. Therefore, with this structure, it is possible to prevent air bubbles, etc. from entering through the ink-supplying flow-passage inlets 442, the flow destination of which is the liquid ejecting head 36.

In the first embodiment, the tip portion 431 of the connection portion 43 (conical surface) slopes downward with respect to the vertical direction from the center toward the circumference. Therefore, the farther the flow-passage inlets 442 for ink ejection are located outside in relation to the flow-passage inlets 452 for ink collection as viewed from above in the vertical direction, the greater the level difference between the flow-passage inlets 452 and the flow-passage inlets 442 is. This makes it harder for air bubbles, etc. to enter through the flow-passage inlets 442 for ink ejection.

Figure 10:
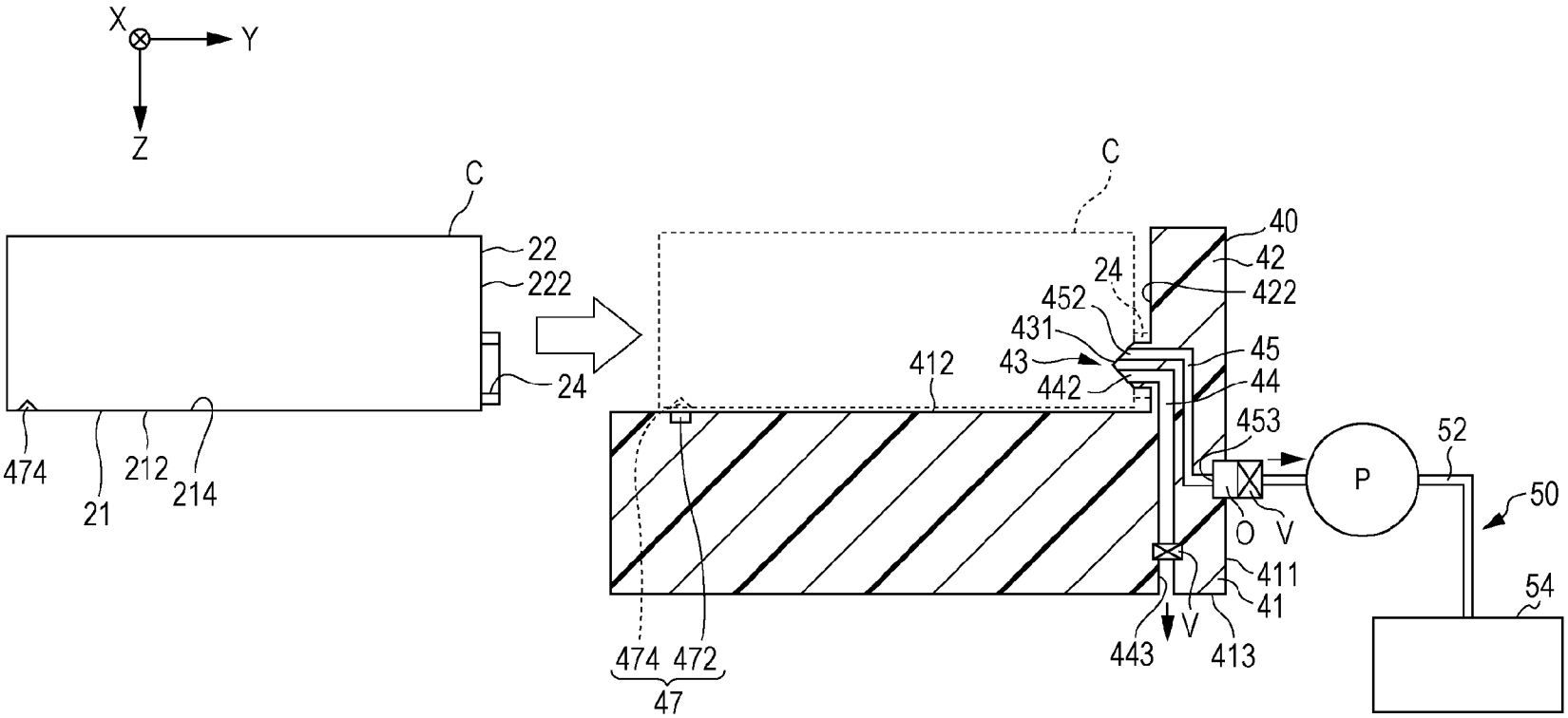
FIG. 10 is a sectional view of a connection portion according to a variation example of the first embodiment, and a top view.

In the example illustrated in FIG. 4, the liquid container C is attached to the inner bottom surface 412 of the attachment unit 40. However, the scope of the invention is not limited thereto. For example, as illustrated in FIG. 10, the liquid container C may be attached to an inner side surface of the attachment unit 40. The attachment unit 40 illustrated in FIG. 10 has, on its sidewall 42, a connection portion 43 that protrudes from an inner side surface 422 of the sidewall 42 toward the negative side −Y in the Y direction.

Since the attachment unit 40 illustrated in FIG. 10 does not have the negative-side −Y sidewall, it is possible to insert the liquid container C into the attachment unit 40 through this wall-less side. Therefore, it is possible to detachably attach the liquid container C to the inner side surface 422 of the attachment unit 40. The connection portion 43 illustrated in FIG. 10 has a needle shape, meaning that its tip 431 is pointed. The pointed tip 431 is inserted into the liquid container C to take in ink. More specifically, a connection port 24, which is in communication with the inside of the liquid container C, is provided on the outer surface 222 (+Y side) of a sidewall 22 of the liquid container C, and the connection portion 43 is inserted into the connection port 24.

The connection portion 43 illustrated in FIG. 10 protrudes from the inner side surface 422 of the attachment unit 40 toward the negative side −Y in the Y direction. The cone-shaped tip portion 431 of the connection portion 43 has, in its conical surface (slope), a plurality of inlets 442 of a first flow passage 44 for ink ejection and a plurality of inlets 452 of a second flow passage 45 for ink collection separately.

Figure 11:
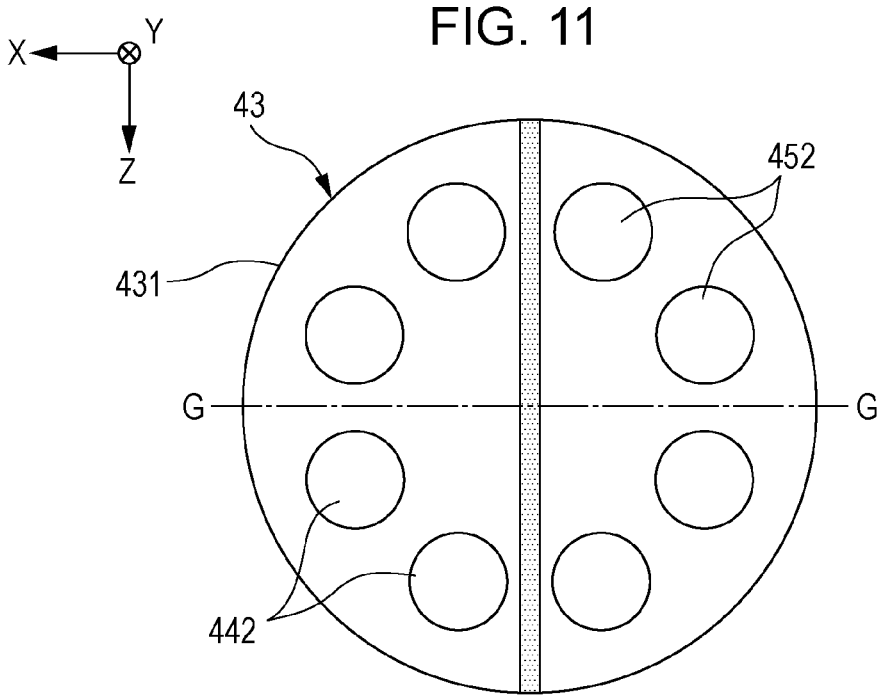
FIG. 11 is a side view of the connection portion illustrated in FIG. 10.

FIG. 11 is a Y-directional side view of the tip portion 431 of the connection portion 43 illustrated in FIG. 10. As illustrated in FIG. 11, the plural flow-passage inlets 452 for ink collection are located above the plural flow-passage inlets 442 for ink ejection in the Z direction (vertical direction). Assuming that a virtual G-G line goes through the center of the tip portion 431 of the connection portion 43 in parallel with the X direction, the plural flow-passage inlets 452 for ink collection are located above the G-G line in the Z direction (thereabove in the vertical direction), and the plural flow-passage inlets 442 for ink ejection are located below the G-G line in the Z direction (therebelow in the vertical direction). In this layout, the area above the G-G line is located at a higher-level position in the vertical direction as compared with the area below the G-G line. Therefore, the level of the flow-passage inlets 452 for ink collection, which are located above the G-G line, is higher than the level of the flow-passage inlets 442 for ink ejection, which are located below the G-G line. The flow-passage inlets 442 for ink ejection and the flow-passage inlets 452 for ink collection are not limited to plural annular-array through holes as in FIG. 11. For example, the inlet shape may be a ring-groove shape. Similarly to FIG. 11, when such a ring-groove structure is adopted, the flow-passage inlet 452 for ink collection is arranged above the G-G line, and the flow-passage inlet 442 for ink ejection is arranged below the G-G line. Therefore, the level of the flow-passage inlet 452 for ink collection is higher than the level of the flow-passage inlet 442 for ink ejection. Similarly to FIG. 4, the ink-supplying first flow passage 44 illustrated in FIG. 10 is in communication with a flow-passage outlet 443, which is open at the outer surface 413 of the bottom wall 41 of the attachment unit 40. In addition, similarly to FIG. 4, the downstream end of the second flow passage 45 for ink collection is connected to the opening O.

When the liquid container C illustrated in FIG. 10 is attached to the inner side surface 422 of the attachment unit 40 having the above structure, the connection portion 43 enters the connection port 24 of the liquid container C. When this insertion is performed, the tip portion 431 of the attachment unit 40 becomes positioned inside the liquid container C in such a way as to protrude through the sidewall 22 of the liquid container C toward the negative side −Y in the Y direction. To supply ink to the liquid ejecting head 36, the pump, which is not illustrated, is driven. When pumped, ink flows out of the liquid container C into the ink-supplying flow-passage inlets 442 of the connection portion 43, and next through the first flow passage 44. By this means, it is possible to supply the ink to the liquid ejecting head 36.

Figure 12:
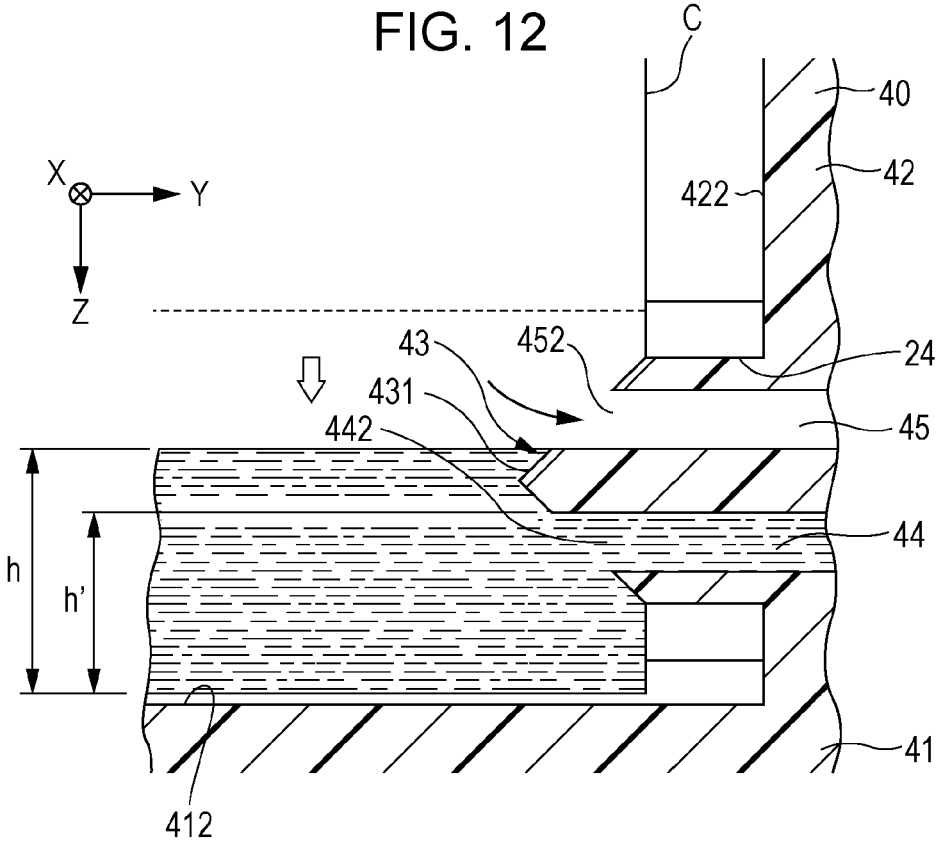
FIG. 12 is a diagram for explaining the operation of the connection portion illustrated in FIG. 10.

For ink collection into the collection container 54, the suction pump P of the collection unit 50 is driven. When pumped, ink flows out of the liquid container C into the ink-collecting flow-passage inlets 452 of the connection portion 43, and next through the second flow passage 45, and finally into the collection container 54. As illustrated in FIG. 12, the surface of ink (liquid level) in the vertical direction drops when ink is sucked out through the ink-collecting flow-passage inlets 452, and the drop in the liquid level stops at the level h of the ink-collecting flow-passage inlets 452. Since the liquid level of ink h is above the level h' of the ink-supplying flow-passage inlets 442, as in FIG. 9, this structure prevents air bubbles from entering through the ink-supplying flow-passage inlets 442.

Some printers are designed to notify a user of an ink-low (near-end) state, that is, a state in which the amount of ink left in the liquid container C is small. For example, a lamp goes ON to let a user know that it is time to replace the liquid container C with new one. If ink is consumed until the liquid container C becomes completely empty, there is a risk that air bubbles might enter the liquid ejecting head 36, resulting in poor ejection. A near-end notification is made to avoid this from happening. However, in such a case, there exists a small amount of ink left in the liquid container C when the time to replace the liquid container C with new one is detected by the controller 30. Therefore, if the user detaches and shakes the liquid container C carelessly, there is a risk of the splattering of the ink.

In this respect, with the structure of the first embodiment, even if the above-mentioned ink-low near-end state has been programmed in advance in association with the time to replace the liquid container C with new one, it is possible to remove a large part of the residual ink until the residual liquid level becomes very close to the inner bottom surface 214 of the liquid container C. Moreover, air bubbles do not go in through the ink-supplying flow-passage inlets 442. By performing residual ink collection described above, it is possible to eliminate a risk of the splattering of ink even if a user shakes the liquid container C inadvertently, while ensuring that air bubbles do not go in through the ink-supplying flow-passage inlets 442.

Residual Ink Collection Method

Figure 13:
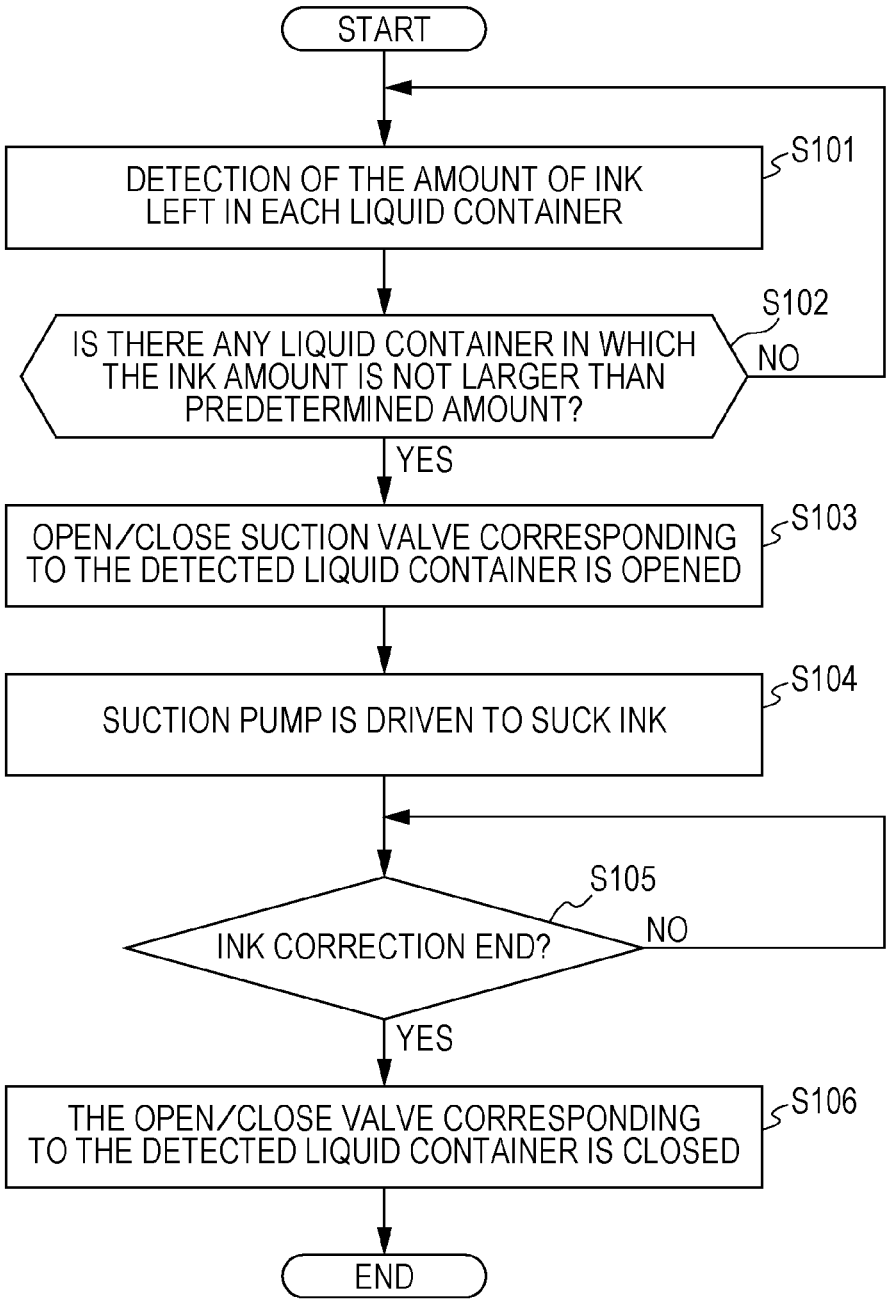
FIG. 13 is a flowchart that illustrates residual ink collection control performed by a controller.

Next, a method for collecting ink left in the liquid container C1 to C4 according to the first embodiment will now be explained in detail. FIG. 13 is a flowchart that illustrates residual ink collection control performed by the controller 30. First, in a step S101, the controller 30 causes the liquid amount detector 47 to detect the amount of ink left in each of the liquid containers C1 to C4. In a step S102, the controller 30 judges whether, for any of the liquid containers C1 to C4, the ink amount detected by the liquid amount detector 47 is not greater than a predetermined value (near end) or not. By performing ink amount detection processing for each of the liquid containers C1 to C4 in this way, the controller 30 detects one or more liquid containers C1 to C4 that need to be replaced, if any. Instead of "not greater than a predetermined value", "less than a predetermined value" may be defined as "near end".

The process returns to the step S101 if there is no near-end container, specifically, if it is judged by the controller 30 in the step S102 that, for none of the liquid containers C1 to C4, the ink amount is not greater than the predetermined value. If it is judged by the controller 30 in the step S102 that the amount of ink left in any of the liquid containers C1 to C4 is not greater than the predetermined value (near end) (assume that the amount of ink left in the liquid container C is not greater than the predetermined value), in a step S103, among the open/close valves V1 to V4 illustrated in FIG. 2, one corresponding to the liquid container C is opened. When it is opened, the other valves are kept closed.

Next, in a step S104, to suck ink out of the liquid container C, the controller 30 drives the suction pump P of the collection unit 50. As a result, ink is sucked out of the liquid container C only. The sucked ink goes to the collection container 54. Next, in a step S105, the controller 30 judges whether residual ink collection has ended or not. For example, to judge whether residual ink collection has ended or not, it is judged whether predetermined time has elapsed or not. The method of judgment is not limited thereto. It may be judged on the basis of the ink amount detected by the liquid amount detector 47. Alternatively, an optical sensor for detecting the presence or absence of ink in the collection flow passage 52 may be provided. The controller 30 can judge that residual ink collection has ended when the absence of ink in the collection flow passage 52 is detected by the optical sensor.

The processing in the step S104 continues if the controller 30 judges in the step S105 that residual ink collection has not ended yet. If the controller 30 judges in the step S105 that residual ink collection has ended, in a step S106, the open/close valve corresponding to the liquid container C is closed to finish the series of collection control steps.

With the residual ink collection control illustrated in FIG. 13, it is possible to collect residual ink by, under the control of the controller 30, detecting the amount of ink for each of the liquid containers C1 to C4 and opening only the open/close valve corresponding to the liquid container whose ink amount is not greater than the predetermined value. For example, if the amount of ink left in the liquid container C4 is not greater than the predetermined value, the controller 30 opens the open/close valve V4, which corresponds to the liquid container C4, and drives the suction pump P. Since the other open/close valves V1, V2, and V3 remain closed, it is possible to suck ink out of the liquid container C4 only. Moreover, if the suction pump P is driven for predetermined time, the drop in the liquid level stops at the level of the ink-collecting flow-passage inlets 452 as illustrated in FIG. 9 or 12. Therefore, it is possible to prevent air bubbles, etc. from entering through the ink-supplying flow-passage inlets 442 without any need for precisely setting the predetermined duration of driving the suction pump P.

Second Embodiment

Figure 14:
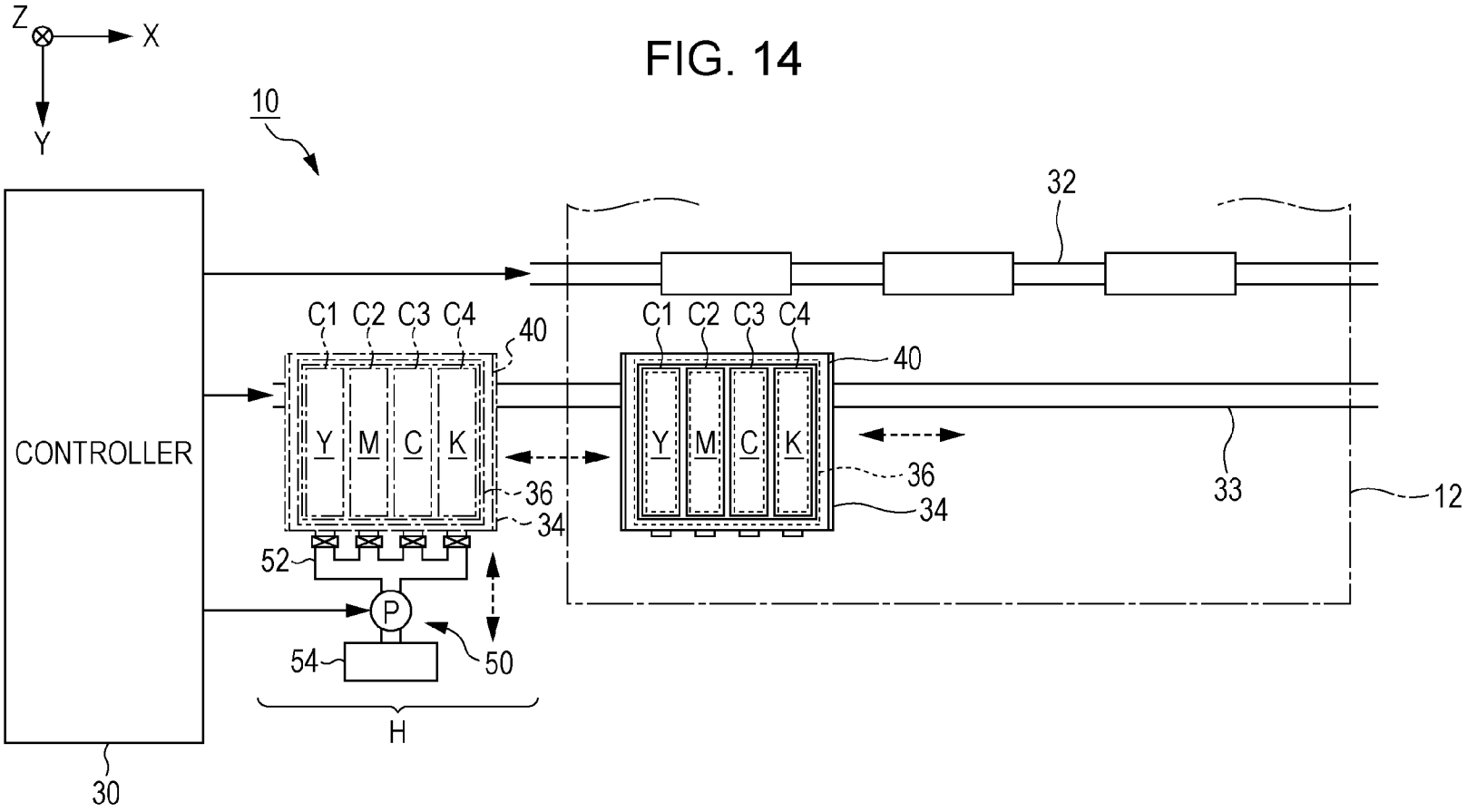
FIG. 14 is a structure diagram of a printing apparatus according to a second embodiment.

A second embodiment of the invention will now be explained. FIG. 14 is a partial structure diagram of a printing apparatus 10 according to a second embodiment. In the first embodiment, a so-called off-carriage-type structure, in which the liquid containers C1 to C4 are mounted on the body of the printing apparatus 10, has been described. In the second embodiment, a so-called on-carriage-type structure, in which the liquid containers C1 to C4 are mounted on the carriage 34, is taken as an example. In each exemplary embodiment described below, the same reference numerals as those used in the description of the first embodiment are assigned to elements that are the same in operation and/or function as those in the first embodiment, and a detailed explanation of them is omitted.

The liquid containers C1 to C4 illustrated in FIG. 14 are mounted together with the liquid ejecting head 36 on the carriage 34. That is, in the structure illustrated in FIG. 14, the attachment unit 40 illustrated in FIG. 2 is provided on the carriage 34, and the collection unit 50 is provided on the body of the printing apparatus 10.

As illustrated in FIG. 14, the collection unit 50 is provided in a non-print area H, for example, at the home position (standby position) of the carriage 34 in the X direction. Specifically, the collection unit 50 is provided in the non-print area H at the positive side in the Y direction with respect to the home position of the carriage 34. As illustrated in FIG. 14, the collection unit 50 is configured to be able to reciprocate from the positive side toward the negative side and vice versa in the Y direction so as to be able to be attached to and detached from the attachment unit 40 mounted on the carriage 34.

Figure 15:
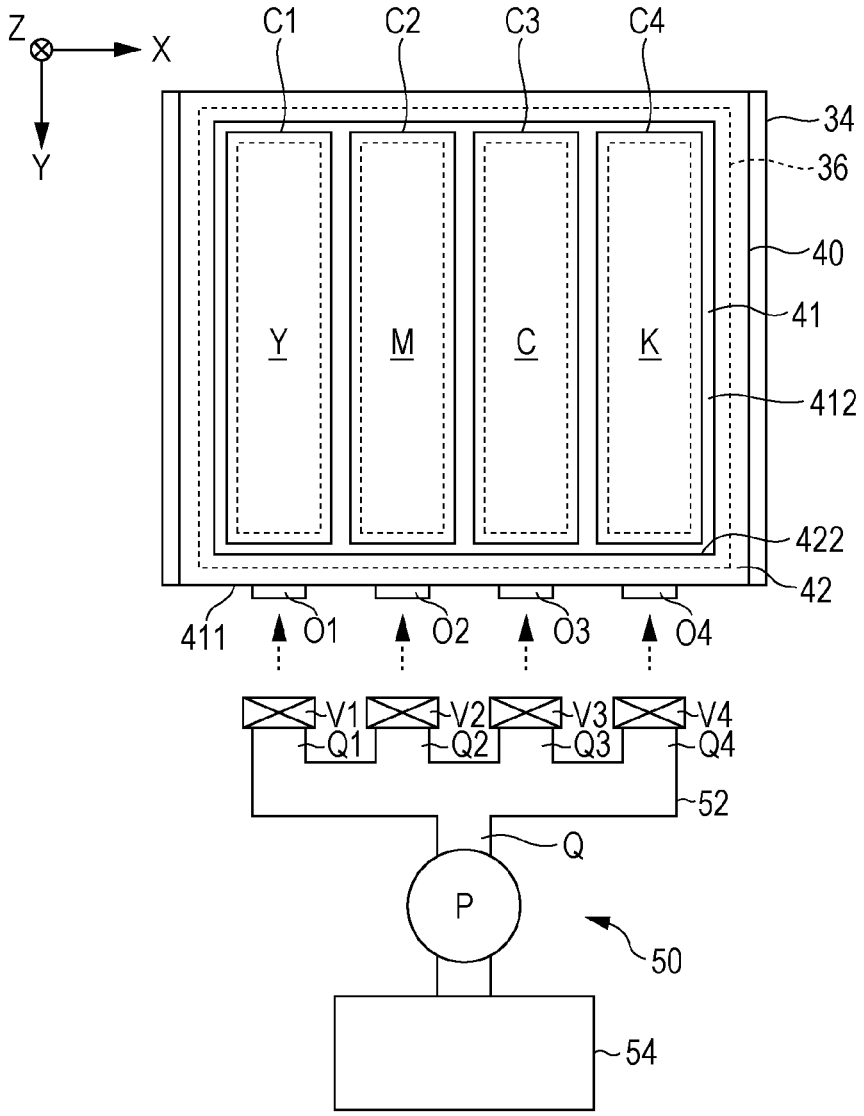
FIG. 15 is an enlarged view of an attachment unit for liquid containers according to the second embodiment, and of a collection unit.

FIG. 15 is a diagram for explaining the operation of the collection unit 50 when the carriage 34 stays at the home position. Due to the reciprocation of the collection unit 50 between the positive side and the negative side in the Y direction when the carriage 34 stays at the home position, the branch flow passages Q1 to Q4 of the collection flow passage 52 are connected to and disconnected from the respective openings O1 to O4 of the attachment unit 40. The standby position of the collection unit 50 is located at the positive side in the Y direction with respect to the home position of the carriage 34.

In the second embodiment, the same structure as that of the first embodiment can be adopted for the attachment unit 40, including the connection portion 43. By this means, in the second embodiment, it is possible to collect the residual ink of the liquid container C1 to C4 as in the first embodiment, thereby preventing air bubbles from entering through the ink-supplying flow-passage inlets 442. The controller 30 of the second embodiment is also capable of performing residual ink collection control illustrated in FIG. 13. After the movement of the carriage 34 to the home position, the controller 30 causes the collection unit 50 to move toward the negative side in the Y direction so as to connect the branch flow passages Q1 to Q4 of the collection flow passage 52 to the respective openings O1 to O4 of the attachment unit 40 and thereafter opens the open/close valve in the step S103. After the closing of the open/close valve in the step S106, the controller 30 causes the collection unit 50 to move back toward the positive side in the Y direction to its standby position so as to disconnect the branch flow passages Q1 to Q4 of the collection flow passage 52 from the respective openings O1 to O4 of the attachment unit 40. By this means, in the second embodiment, the same effects as those of the first embodiment can be expected.

Third Embodiment

Figure 16:
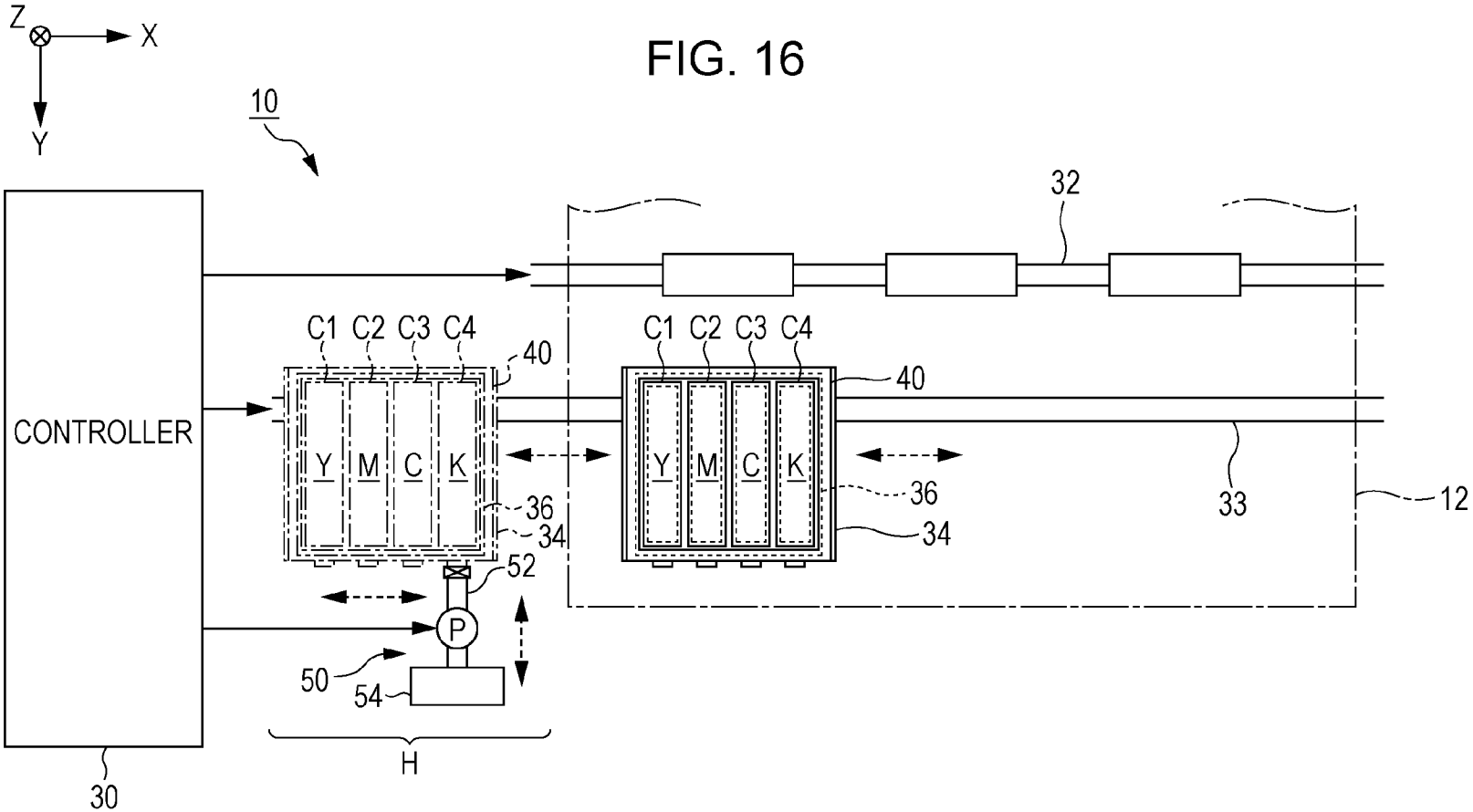
FIG. 16 is a structure diagram of a printing apparatus according to a third embodiment.
Figure 17:
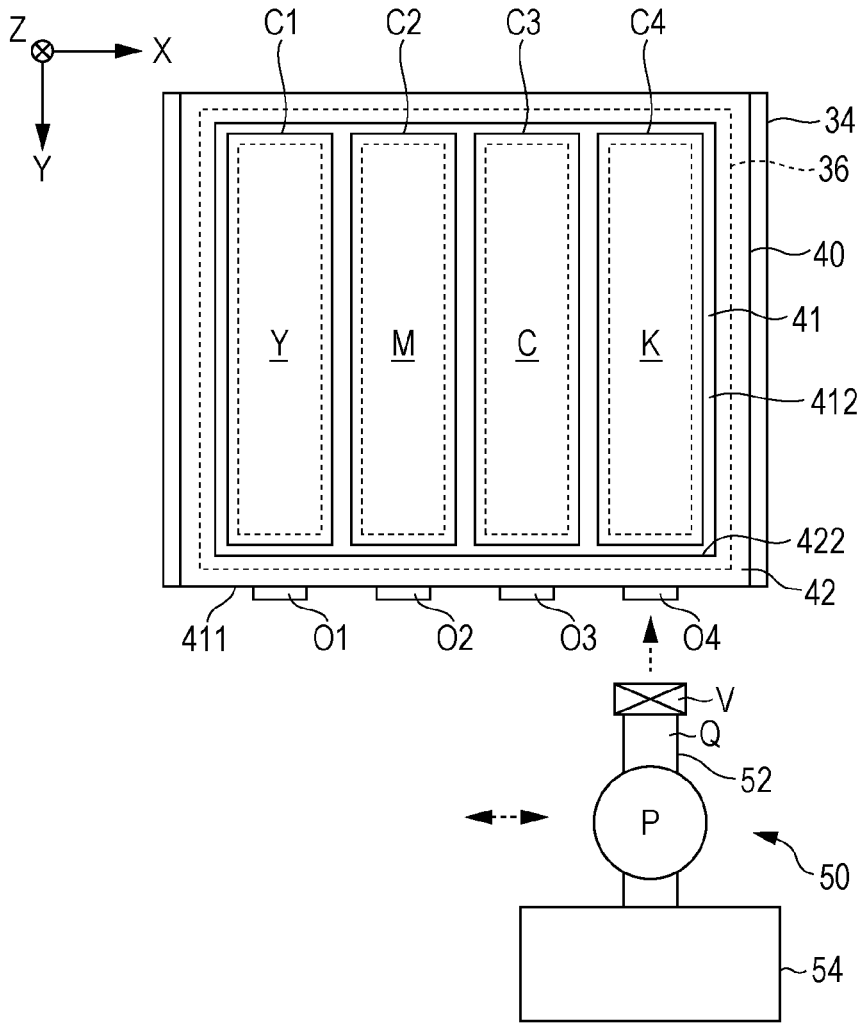
FIG. 17 is an enlarged view of an attachment unit for liquid containers according to a third embodiment, and of a collection unit.

A third embodiment of the invention will now be explained. FIG. 16 is a partial structure diagram of a printing apparatus 10 according to a third embodiment. As in the second embodiment, the printing apparatus 10 of the third embodiment has a so-called on-carriage-type structure, in which the liquid containers C1 to C4 are mounted on the carriage 34. Unlike the second embodiment, the collection unit 50 of the third embodiment includes a non-branched collection flow passage 52. In addition, as illustrated in FIG. 17, the collection unit 50 of the third embodiment is configured to be able to reciprocate not only in the Y direction but also in the X direction. The structure of the attachment unit 40 of the third embodiment is the same as that of the first embodiment. By this means, in the third embodiment, it is possible to collect the residual ink of the liquid container C1 to C4 as in the first embodiment, thereby preventing air bubbles from entering through the ink-supplying flow-passage inlets 442. Residual ink may be collected from any liquid container C1 to C4 by, instead of moving the collection unit 50 in the X direction, moving the carriage 34 in the X direction for X-directional positional adjustment; specifically, the carriage 34 is moved to align one of the openings O1 to O4 with the collection flow passage 52 of the collection unit 50, followed by connection, and collection.

The controller 30 of the third embodiment is also capable of performing residual ink collection control illustrated in FIG. 13. After the movement of the carriage 34 to the home position, the controller 30 causes the collection unit 50 to move both in the X direction and in the Y direction so as to connect the collection flow passage 52 to, among the openings O1 to O4, only one corresponding to the liquid container from which residual ink is to be collected (in FIG. 17, the opening O4 only) and thereafter opens the open/close valve V in the step S103. After the closing of the open/close valve V in the step S106, the controller 30 causes the collection unit 50 to move both in the Y direction and in the X direction back to its standby position so as to disconnect the collection flow passage 52 from the opening of the attachment unit 40. By this means, in the third embodiment, the same effects as those of the first embodiment can be expected. In addition, in the third embodiment, it is sufficient to provide a single open/close valve V on the collection flow passage 52. As compared with a structure in which the open/close valves V1 to V4 corresponding to the respective liquid containers C1 to C4 are provided, it is possible to simplify open/close valve control because no selection among the open/close valves V1 to V4 is necessary.

Figure 18:
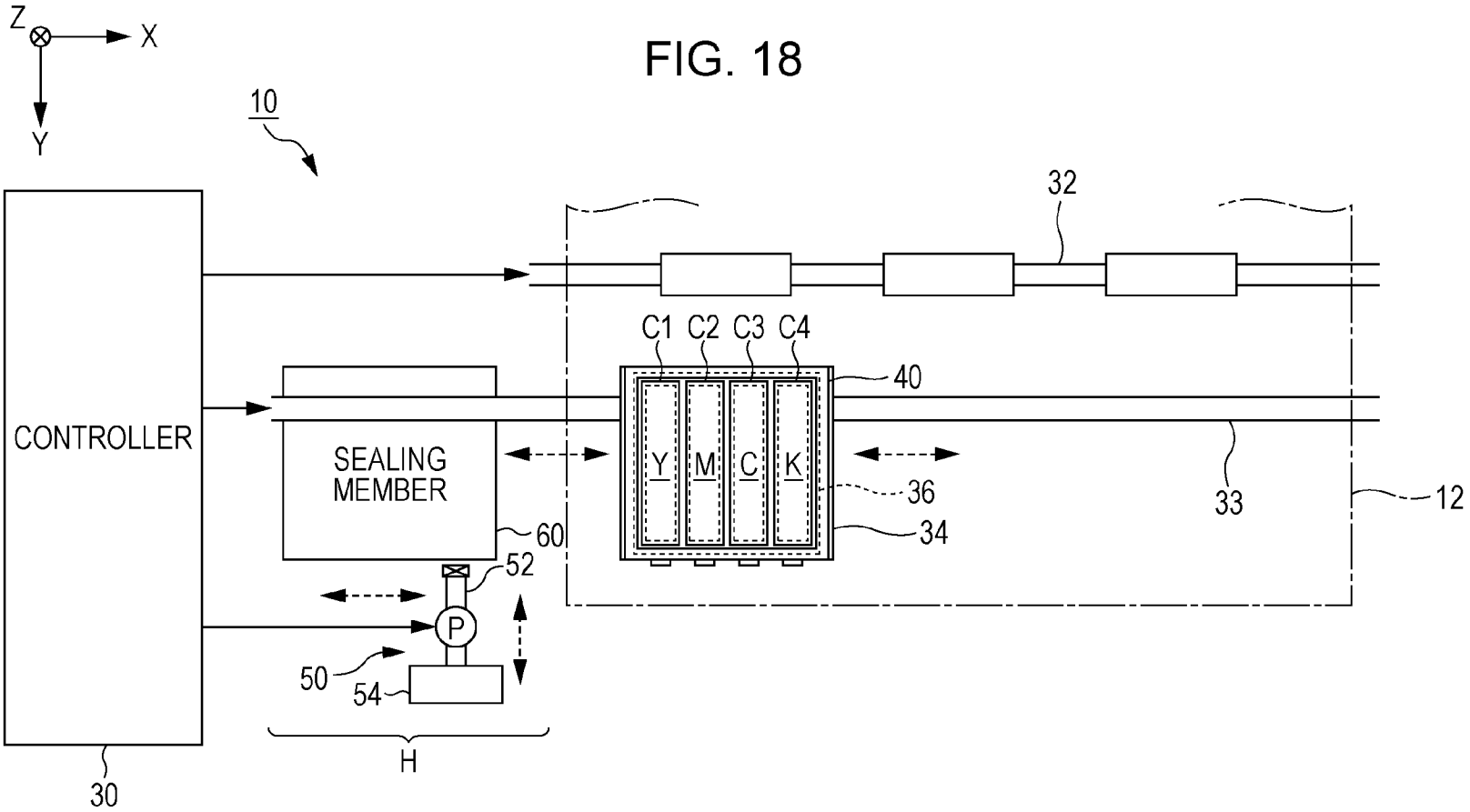
FIG. 18 is a structure diagram of a printing apparatus according to a variation example of the third embodiment.

In the printing apparatus 10 of the third embodiment, after the movement of the liquid ejecting head 36 to the home position H, the ejecting face of the liquid ejecting head 36 may be sealed (capped) with a sealing member (cap) before the collection of residual ink by the collection unit 50. Specifically, as illustrated in FIG. 18, the ejecting face of the liquid ejecting head 36 is sealed with a sealing member 60, which is provided at the home position H of the printing apparatus 10. The sealing member 60 is a capping member that is open toward the ejecting face of the liquid ejecting head 36. The sealing of the ejecting face of the liquid ejecting head 36 with the sealing member 60 makes it easier to withstand pressure fluctuation that occurs inside the liquid ejecting head 36 when residual ink is sucked by the collection unit 50. Moreover, since the nozzles N are sealed by the sealing member 60, when residual ink is sucked by the collection unit 50, the sealing prevents the entering of air bubbles into the ink-supplying flow passage of the liquid ejecting head 36 through the nozzles N effectively. As stated above, it is possible to suck residual ink without an influence on the ink-supplying flow passage of the liquid ejecting head 36. During the sealing of the liquid ejecting head 36 with the sealing member 60, the liquid ejecting head 36 cannot be moved in the X, Y direction. In this respect, since the collection unit 50 of the third embodiment is movable not only in the Y direction but also in the X direction, it is possible to connect the collection flow passage 52 to one of the openings O1 to O4 even when the liquid ejecting head 36 cannot be moved. Another maintenance member such as a suction pump for the recovery of clogged nozzles N may be provided for the sealing member 60.

Fourth Embodiment

A fourth embodiment of the invention will now be explained. The printing apparatus 10 described in the first, second, and third embodiments is a serial-head printer in which the carriage 34, together with the liquid ejecting head 36 mounted thereon, moves in the X direction. In the fourth embodiment, a line-head printer whose liquid ejecting head 36 is elongated in a direction intersecting with the transportation direction of the medium 12 (elongated in the X direction here) is taken as example.

Figure 19:
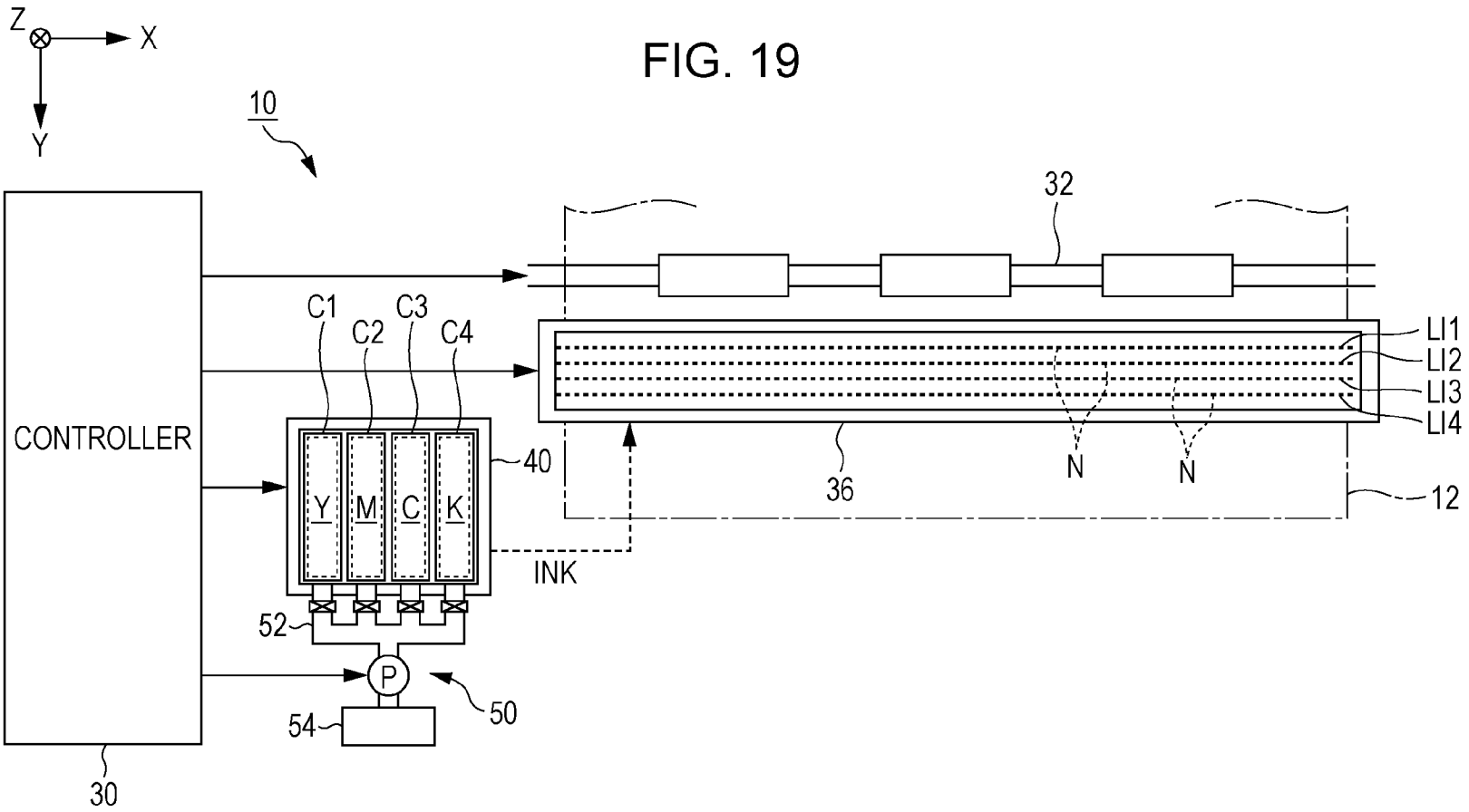
FIG. 19 is a structure diagram of a printing apparatus according to a fourth embodiment.

FIG. 19 is a partial structure diagram of a printing apparatus 10 according to a fourth embodiment. The liquid ejecting head 36 of the printing apparatus 10 illustrated in FIG. 19 is a line head on the ejecting face of which four ink nozzle lines L11 to L14 are arranged at Y-directional intervals. Each of the ink nozzle lines L11 to L14 is a group of plural nozzles N that are in a linear array along the X direction. Each of the ink nozzle lines L11 to L14 may consist of plural rows (for example, zigzag array or staggered array).

As in the first embodiment, the printing apparatus 10 illustrated in FIG. 19 has a so-called off-carriage-type structure, in which the liquid containers C1 to C4 are mounted on the body of the printing apparatus 10. The structure and position of the attachment unit 40 and of the collection unit 50 illustrated in FIG. 19 is the same as that of the first embodiment. Yellow ink (Y), which is supplied from the liquid container C1, is ejected from the nozzles N of the ink nozzle line L11. Magenta ink (M), which is supplied from the liquid container C2, is ejected from the nozzles N of the ink nozzle line L12. Cyan ink (C), which is supplied from the liquid container C3, is ejected from the nozzles N of the ink nozzle line L13. Black ink (K), which is supplied from the liquid container C4, is ejected from the nozzles N of the ink nozzle line L14. Since the structure of the attachment unit 40 and of the collection unit 50 in the fourth embodiment is the same as that of the first embodiment, the same effects as those of the first embodiment can be expected in the fourth embodiment.

Variation Examples

The exemplary embodiments described above can be modified in various ways. Specific variation examples are described below. Two or more variation examples selected arbitrarily from the description below may be combined as long as they are not contradictory to each other or one another.

Figure 20:
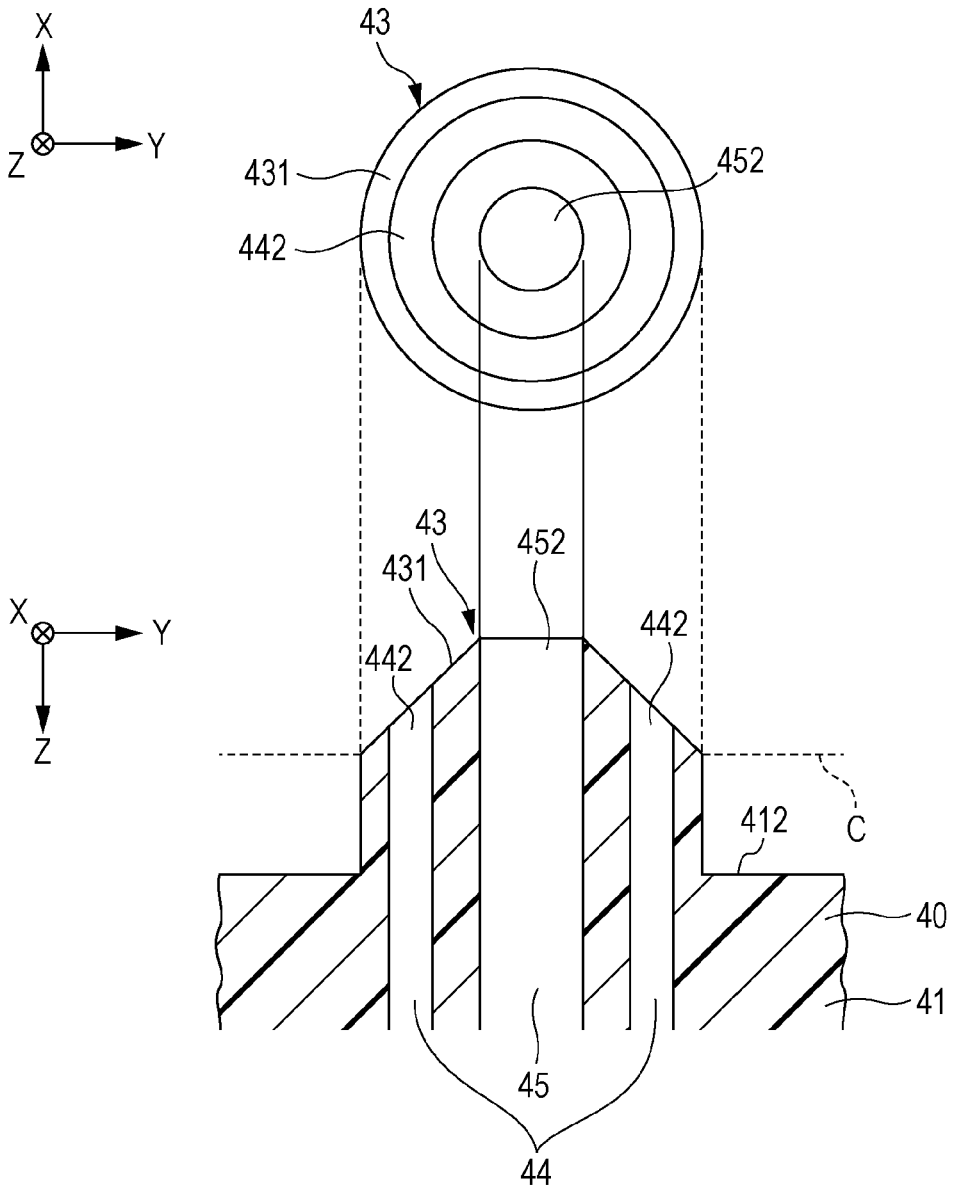
FIG. 20 is a sectional view and a top view of a connection portion according to a variation example.
Figure 21:
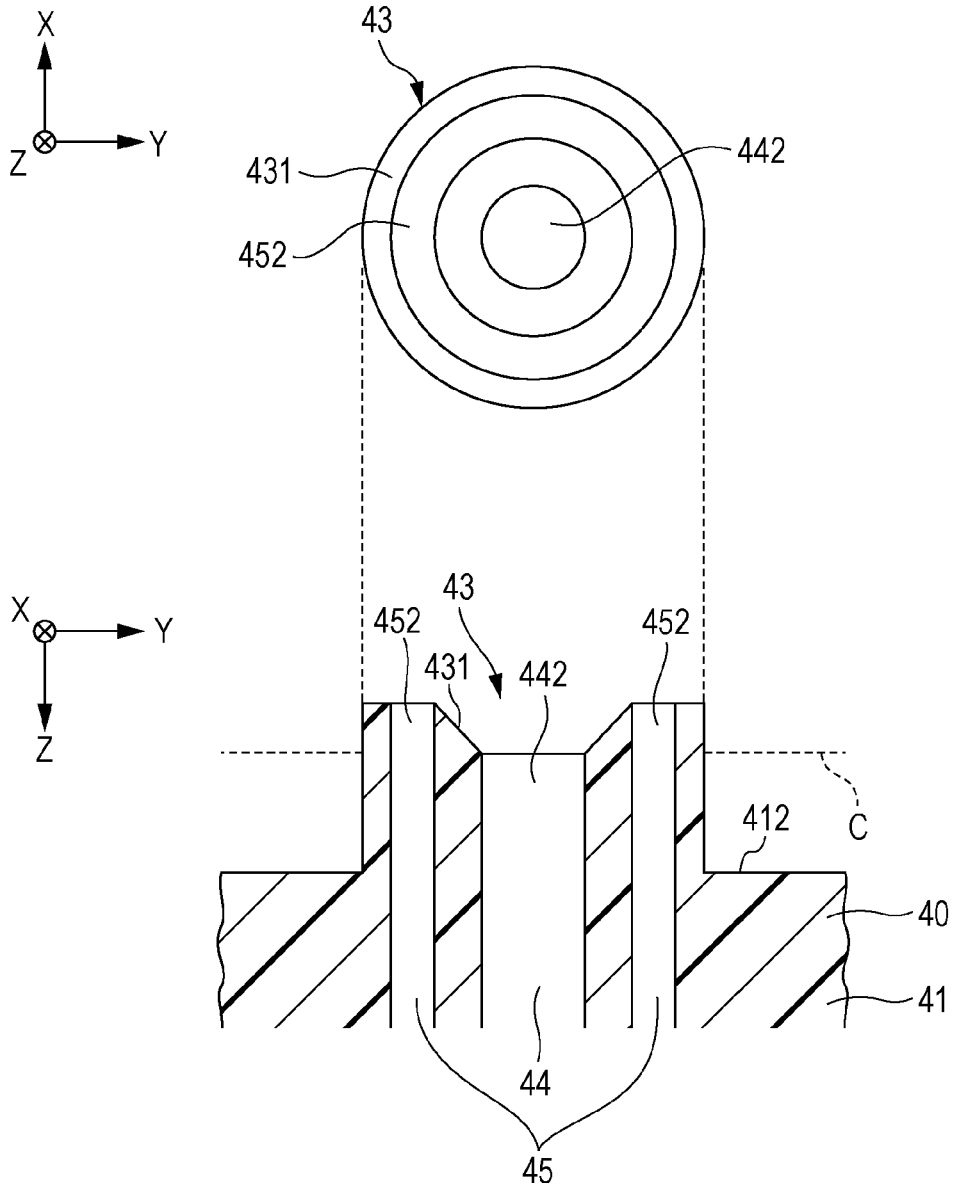
FIG. 21 is a sectional view and a top view of a connection portion according to another variation example.

(1) The structure of the connection portion 43 of the attachment unit 40 is not limited to the foregoing examples in the embodiments. For example, the connection portion 43 illustrated in FIG. 5 may be modified as illustrated in FIG. 20. The connection portion 43 illustrated in FIG. 20 has an inlet 452 of the second flow passage 45 for ink collection at the center of the tip portion 431 of the connection portion 43, and has an inlet 442 of the first flow passage 44 for ink supply therearound. Though a ring groove is illustrated as an example of the ink-supplying flow-passage inlet 442 in FIG. 20, it is not limited thereto. The connection portion 43 may have plural ink-supplying flow-passage inlets 442 that are plural through holes arranged annularly. Though the tip portion 431 of the connection portion 43 illustrated in FIG. 20 has a convex structure protruding upward in the vertical direction, it may be modified into a concave structure illustrated in FIG. 21. In FIG. 21, the tip portion 431 of the connection portion 43 is recessed vertically. Similarly to the first embodiment, in the structure illustrated in FIG. 20 and the structure illustrated in FIG. 21, the flow-passage inlet 452 for ink collection is located above the flow-passage inlet 442 for ink ejection in the Z direction (vertical direction). Therefore, when ink is sucked through the flow-passage inlet 452 for ink collection, the entering of air bubbles through the ink-ejecting flow-passage inlet 442 is prevented. However, the convex tip portion 431 of the connection portion 43 illustrated in FIG. 20 produces a greater effect of preventing air bubbles from entering through the ink-ejecting flow-passage inlet 442 than that of the concave tip portion 431 of the connection portion 43 illustrated in FIG. 21.

(2) The structure of the liquid ejecting head 36 can be modified. For example, though a piezoelectric liquid ejecting head 36 utilizing a piezoelectric element that applies mechanical vibration to a pressure compartment is disclosed as an example in the foregoing embodiments, a thermal liquid ejecting head utilizing a heat generation element that produces an air bubble inside a pressure compartment by heating may be employed instead. The structure of the plural nozzles N in the liquid ejecting head 36 is not limited to the foregoing examples in the embodiments.

(3) The printing apparatus disclosed as examples in the foregoing embodiments can be applied to various kinds of equipment such as facsimiles and copiers, etc. in addition to print-only machines. The scope of application of a liquid ejecting apparatus according to the present invention is not limited to printing. For example, a liquid ejecting apparatus that ejects a colorant solution can be used as an apparatus for manufacturing a color filter of a liquid crystal display device. A liquid ejecting apparatus that ejects a solution of a conductive material can be used as a manufacturing apparatus for forming wiring lines and electrodes of a wiring substrate.

The entire disclosure of Japanese Patent Application No. 2015-230470, filed Nov. 26, 2015 is expressly incorporated by reference herein.

What is claimed is:

1. A liquid ejecting apparatus, comprising:
- an attachment unit to which a liquid container that contains liquid is attachable;
- a liquid ejecting head that ejects the liquid; and
- a connection portion that is provided on the attachment unit and is detachably inserted into a single connection port of the liquid container,
- wherein the connection portion has both at least one opening of a first flow passage and at least one opening of a second flow passage, the at least one opening of the first flow passage and the at least one opening of the second flow passage being separately positioned in the connection portion,
- wherein the first flow passage is a passage through which the liquid contained in the liquid container is sent to the liquid ejecting head, and
- wherein the second flow passage is a passage through which the liquid contained in the liquid container is sent, but not to the liquid ejecting head,
- wherein a level of the opening of the second flow passage is higher than a level of the opening of the first flow passage in a vertical direction.

2. The liquid ejecting apparatus according to claim 1, wherein, as viewed in a direction of insertion of the connection portion, the opening of the first flow passage and the opening of the second flow passage are arranged to surround the center of the connection portion.

3. The liquid ejecting apparatus according to claim 1, wherein the connection portion protrudes upward from an inner bottom surface of the attachment unit.

4. The liquid ejecting apparatus according to claim 1, wherein the connection portion protrudes sideways from an inner side surface of the attachment unit.

5. The liquid ejecting apparatus according to claim 1, wherein the liquid ejecting head and the attachment unit are provided on a moving member that reciprocates.

6. The liquid ejecting apparatus according to claim 1, wherein the liquid ejecting head is provided on a moving member that reciprocates; and wherein the attachment unit is provided on a body of the liquid ejecting apparatus.

7. The liquid ejecting apparatus according to claim 1, wherein the liquid ejecting head is an elongated line head; and wherein the liquid ejecting head and the attachment unit are fixed.

8. The liquid ejecting apparatus according to claim 1, further comprising:

a third flow passage for collection of the liquid sent through the second flow passage, wherein the third flow passage is detachably connected to the second flow passage.

9. The liquid ejecting apparatus according to claim 1, further comprising:

an other connection portion provided on the attachment unit, the other connection portions having structures same as the connection portion, wherein the other connection portion being detachably inserted into a connection port of another liquid container containing liquid so that the other liquid container is attachable to the attachment unit, wherein the other connection portion has at least one opening of a first flow passage and at least one opening of a second flow passage separately, wherein the first flow passage of the other connection portion is a passage through which the liquid contained in the other liquid container is sent to the liquid ejecting head, and wherein the second flow passage of the other connection portion is a passage through which the liquid contained in the other liquid container is sent, but not to the liquid ejecting head.

10. The liquid ejecting apparatus according to claim 9, further comprising:

a third flow passage for collection of the liquid sent through the second flow passages of the connection portion and the other connection portion, wherein the third flow passage is detachably connected to each of the second flow passages of the connection portion and the other connection portion so that the third flow passage connects to, among the second flow passages of the connection portion and the other connection portion, only one intended to collect the liquid.

11. A liquid ejecting method for a liquid ejecting apparatus, the liquid ejecting apparatus including an attachment unit to which a plurality of liquid containers each containing liquid is attachable, a liquid ejecting head that ejects the liquid, a plurality of connection portions provided on the attachment unit, each of the plurality of connection portions being detachably inserted into a corresponding single connection port of the corresponding liquid container, each of the plurality of connection portions having at least one opening of a first flow passage and at least one opening of a second flow passage, the first flow passage being a passage through which the liquid contained in the liquid container is sent to the liquid ejecting head, the second flow passage being a passage through which the liquid contained in the liquid container is sent, but not to the liquid ejecting head, a third flow passage for collection of the liquid sent through the second flow passage being connected to each of the second flow passages, a valve being provided between each of the second flow passages and the third flow passage so as to be able to open and close therebetween, and a detector that detects an amount of the liquid left in each of the plurality of liquid containers, the liquid ejecting method comprising:

detecting, by the detector, among the plurality of liquid containers, a liquid container in which the amount of the liquid left is not larger than a predetermined amount;

opening the valve between the third flow passage and the second flow passage corresponding to the connection portion inserted in the connection port of the detected liquid container, the at least one opening of the first flow passage and the at least one opening of the second flow passage being separately positioned in the connection portion and received through the connection port; and sucking the liquid out of the liquid container through the second flow passage to which the third flow passage is connected, thereby collecting the sucked liquid through the third flow passage.

12. A liquid ejecting method for a liquid ejecting apparatus, the liquid ejecting apparatus including an attachment unit to which a plurality of liquid containers each containing liquid is attachable, a liquid ejecting head that ejects the liquid, a plurality of connection portions provided on the attachment unit, each of the plurality of connection portions being detachably inserted into a corresponding connection port of the corresponding liquid container, each of the plurality of connection portions having at least one opening of a first flow passage and at least one opening of a second flow passage, the first flow passage being a passage through which the liquid contained in the liquid container is sent to the liquid ejecting head, the second flow passage being a passage through which the liquid contained in the liquid container is sent, but not to the liquid ejecting head, a third flow passage for collection of the liquid sent through the second flow passage being detachably connected to each of the second flow passages, and a detector that detects an amount of the liquid left in each of the plurality of liquid containers, the liquid ejecting method comprising:

detecting, by the detector, among the plurality of liquid containers, a liquid container in which the amount of the liquid left is not larger than a predetermined amount;

connecting the third flow passage to the second flow passage corresponding to the connection portion inserted in the connection port of the detected liquid container, the at least one opening of the first flow passage and the at least one opening of the second flow passage being separately positioned in the connection portion and received through the connection port; and sucking the liquid out of the liquid container through the second flow passage to which the third flow passage is connected, thereby collecting the sucked liquid through the third flow passage.

* * * * *